US008707681B2

(12) United States Patent
Bisaiji et al.

(10) Patent No.: US 8,707,681 B2
(45) Date of Patent: Apr. 29, 2014

(54) EXHAUST PURIFICATION SYSTEM OF INTERNAL COMBUSTION ENGINE

(75) Inventors: Yuki Bisaiji, Mishima (JP); Kohei Yoshida, Gotenba (JP); Mikio Inoue, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 13/259,712

(22) PCT Filed: Jan. 17, 2011

(86) PCT No.: PCT/JP2011/051138

§ 371 (c)(1),
(2), (4) Date: Oct. 3, 2011

(87) PCT Pub. No.: WO2012/098688

PCT Pub. Date: Jul. 26, 2012

(65) Prior Publication Data

US 2013/0291522 A1 Nov. 7, 2013

(51) Int. Cl.
*F01N 3/00* (2006.01)

(52) U.S. Cl.
USPC ..... 60/286

(58) Field of Classification Search
USPC ..... 60/286, 297, 301
See application file for complete search history.

(56) References Cited

U.S. PATENT DOCUMENTS 7,213,395 B2 * 5/2007 Hu et al. ..... 60/286
7,332,135 B2 * 2/2008 Gandhi et al. ..... 422/177
7,650,746 B2 * 1/2010 Hu et al. ..... 60/286
2003/0101713 A1 6/2003 Dalla Betta et al.
2004/0050037 A1 3/2004 Betta et al.
2004/0168431 A1 9/2004 Goralski, Jr. et al.
2007/0016357 A1 * 1/2007 Nakagawa et al. ..... 701/104
2007/0271908 A1 * 11/2007 Hemingway et al. ..... 60/286
2008/0053073 A1 3/2008 Kalyanaraman et al.
2009/0000277 A1 1/2009 Yoshida et al.

(Continued)

FOREIGN PATENT DOCUMENTS

JP A-2000-145434 5/2000
JP A-2004-316458 11/2004

(Continued)

OTHER PUBLICATIONS

Office Action dated Jul. 22, 2013 issued in U.S. Appl. No. 13/255,786.

(Continued)

*Primary Examiner* — Thomas Denion
*Assistant Examiner* — Jason Shanske
(74) *Attorney, Agent, or Firm* — Oliff PLC

(57) ABSTRACT

In an internal combustion engine, inside an engine exhaust passage, a hydrocarbon feed valve (15) an exhaust purification catalyst (13), and a particulate filter (14) are arranged. If the hydrocarbon feed valve (15) feeds hydrocarbons by a period of within 5 seconds, a reducing intermediate is produced inside the exhaust purification catalyst (13). This reducing intermediate is used for $NO_x$ purification processing. When the stored $SO_x$ should be released from the exhaust purification catalyst (13), the air-fuel ratio of the exhaust gas flowing into the exhaust purification catalyst (13) is made rich, the reducing intermediate built up on the exhaust purification catalyst (13) is made to be desorbed in the form of ammonia, and the desorbed ammonia is used to make the exhaust purification catalyst (13) release the stored $SO_x$.

10 Claims, 16 Drawing Sheets

(56) References Cited

U.S. PATENT DOCUMENTS

| | | | | |
|---|---|---|---|---|
| 2009/0191108 | A1* | 7/2009 | Blanchard et al. | 423/239.1 |
| 2010/0005873 | A1* | 1/2010 | Katoh et al. | 73/114.75 |
| 2010/0236224 | A1* | 9/2010 | Kumar et al. | 60/297 |
| 2010/0242459 | A1* | 9/2010 | Tsujimoto et al. | 60/320 |

FOREIGN PATENT DOCUMENTS

| | | |
|---|---|---|
| JP | A-2005-113801 | 4/2005 |
| JP | A-2007-514090 | 5/2007 |
| JP | B2-3969450 | 6/2007 |
| JP | A-2009-168031 | 7/2009 |
| WO | WO 2009/082035 A1 | 7/2009 |

OTHER PUBLICATIONS

International Search Report issued in International Patent Application No. PCT/JP2010/055487 dated Jun. 22, 2010.

U.S. Appl. No. 13/255,786 in the name of Bisaiji et al. filed Sep. 22, 2011.

U.S. Appl. No. 13/499,331 in the name of Bisaiji filed Mar. 30, 2012.

Office Action dated Nov. 7, 2013 issued in U.S. Appl. No. 13/255,786.

* cited by examiner

EXHAUST PURIFICATION SYSTEM OF INTERNAL COMBUSTION ENGINE

TECHNICAL FIELD

The present invention relates to an exhaust purification system of an internal combustion engine.

BACKGROUND ART

Known in the art is an internal combustion engine which arranges, in an engine exhaust passage, an $NO_x$ storage catalyst which stores $NO_x$ which is contained in exhaust gas when the air-fuel ratio of the inflowing exhaust gas is lean and which releases the stored $NO_x$ when the air-fuel ratio of the inflowing exhaust gas becomes rich, which arranges, in the engine exhaust passage upstream of the $NO_x$ storage catalyst, an oxidation catalyst which has an adsorption function, and which feeds hydrocarbons into the engine exhaust passage upstream of the oxidation catalyst to make the air-fuel ratio of the exhaust gas flowing into the $NO_x$ storage catalyst rich when releasing $NO_x$ from the $NO_x$ storage catalyst (for example, see Patent Literature 1).

In this internal combustion engine, the hydrocarbons which are fed when releasing $NO_x$ from the $NO_x$ storage catalyst are made gaseous hydrocarbons at the oxidation catalyst, and the gaseous hydrocarbons are fed to the $NO_x$ storage catalyst. As a result, the $NO_x$ which is released from the $NO_x$ storage catalyst is reduced well.

CITATION LIST

Patent Literature

Patent Literature 1: Japanese Patent No. 3969450

SUMMARY OF INVENTION

Technical Problem

However, there is the problem that when the $NO_x$ storage catalyst becomes a high temperature, the $NO_x$ purification rate falls.

An object of the present invention is to provide an exhaust purification system of an internal combustion engine which can obtain a high $NO_x$ purification rate even if the temperature of the exhaust purification catalyst becomes a high temperature.

Solution to Problem

According to the present invention, there is provided an exhaust purification system of an internal combustion engine wherein an exhaust purification catalyst for reacting $NO_x$ contained in exhaust gas and reformed hydrocarbons to produce a reducing intermediate containing nitrogen and hydrocarbons is arranged in an engine exhaust passage, a precious metal catalyst is carried on an exhaust gas flow surface of the exhaust purification catalyst and a basic exhaust gas flow surface part is formed around the precious metal catalysts, the exhaust purification catalyst has a property of producing the reducing intermediate and reducing $NO_x$ contained in exhaust gas by a reducing action of the produced reducing intermediate if a concentration of hydrocarbons flowing into the exhaust purification catalyst is made to vibrate within a predetermined range of amplitude and within a predetermined range of period and has a property of being increased in storage amount of $NO_x$ which is contained in exhaust gas if a vibration period of the hydrocarbon concentration is made longer than the predetermined range, at the time of engine operation, to produce $NO_x$ contained in the exhaust gas in the exhaust purification catalyst, the concentration of hydrocarbons flowing into the exhaust purification catalyst is made to vibrate within the predetermined range of amplitude and within the predetermined range of period, and, when a stored $SO_x$ should be released from the exhaust purification catalyst, an air-fuel ratio of the exhaust gas which flows into the exhaust purification catalyst is lowered to a targeted rich air-fuel ratio to make the reducing intermediate built up on the exhaust purification catalyst desorb in the form of ammonia and the desorbed ammonia is used to make the exhaust purification catalyst release the stored $SO_x$.

Advantageous Effects of Invention

Even if the temperature of the exhaust purification catalyst becomes a high temperature, a high $NO_x$ purification rate can be obtained.

DESCRIPTION OF EMBODIMENTS

Figure 1:
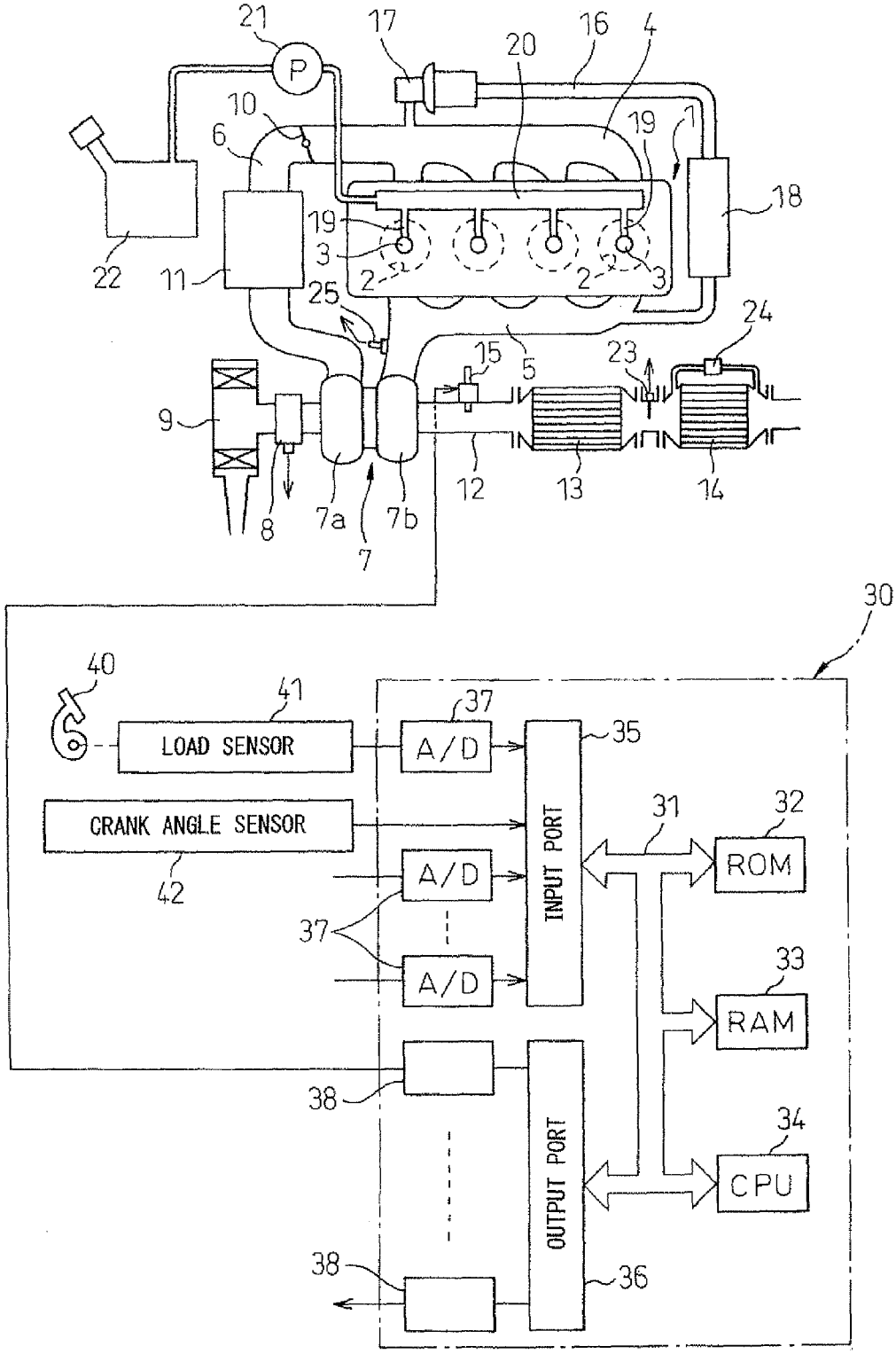
FIG. 1 is an overall view of a compression ignition type internal combustion engine.

FIG. 1 is an overall view of a compression ignition type internal combustion engine.

Referring to FIG. 1, 1 indicates an engine body, 2 a combustion chamber of each cylinder, 3 an electronically controlled fuel injector for injecting fuel into each combustion chamber 2, 4 an intake manifold, and 5 an exhaust manifold. The intake manifold 4 is connected through an intake duct 6 to an outlet of a compressor 7*a* of an exhaust turbocharger 7, while an inlet of the compressor 7*a* is connected through an intake air amount detector 8 to an air cleaner 9. Inside the intake duct 6, a throttle valve 10 driven by a step motor is arranged. Furthermore, around the intake duct 6, a cooling device 11 is arranged for cooling the intake air which flows through the inside of the intake duct 6. In the embodiment shown in FIG. 1, the engine cooling water is guided to the inside of the cooling device 11 where the engine cooling water is used to cool the intake air.

On the other hand, the exhaust manifold 5 is connected to an inlet of an exhaust turbine 7*b* of the exhaust turbocharger 7. The outlet of the exhaust turbine 7*b* is connected through an exhaust pipe 12 to an inlet of the exhaust purification catalyst 13, while the outlet of the exhaust purification catalyst 13 is connected to a particulate filter 14 for trapping particulate which is contained in the exhaust gas. Inside the exhaust pipe 12 upstream of the exhaust purification catalyst 13, a hydrocarbon feed valve 15 is arranged for feeding hydrocarbons comprised of diesel oil or other fuel used as fuel for a compression ignition type internal combustion engine. In the embodiment shown in FIG. 1, diesel oil is used as the hydrocarbons which are fed from the hydrocarbon feed valve 15. Note that, the present invention can also be applied to a spark ignition type internal combustion engine in which fuel is burned under a lean air-fuel ratio. In this case, from the hydrocarbon feed valve 15, hydrocarbons comprised of gasoline or other fuel used as fuel of a spark ignition type internal combustion engine are fed.

On the other hand, the exhaust manifold 5 and the intake manifold 4 are connected with each other through an exhaust gas recirculation (hereinafter referred to as an "EGR") passage 16. Inside the EGR passage 16, an electronically controlled EGR control valve 17 is arranged. Further, around the EGR passage 16, a cooling device 18 is arranged for cooling EGR gas flowing through the inside of the EGR passage 16. In the embodiment shown in FIG. 1, the engine cooling water is guided to the inside of the cooling device 18 where the engine cooling water is used to cool the EGR gas. On the other hand, each fuel injector 3 is connected through a fuel feed tube 19 to a common rail 20. This common rail 20 is connected through an electronically controlled variable discharge fuel pump 21 to a fuel tank 22. The fuel which is stored inside of the fuel tank 22 is fed by the fuel pump 21 to the inside of the common rail 20. The fuel which is fed to the inside of the common rail 20 is fed through each fuel feed tube 19 to the fuel injector 3.

An electronic control unit 30 is comprised of a digital computer provided with a ROM (read only memory) 32, a RAM (random access memory) 33, a CPU (microprocessor) 34, an input port 35, and an output port 36, which are connected with each other by a bidirectional bus 31. Downstream of the exhaust purification catalyst 13, a temperature sensor 23 is attached for detecting the exhaust gas temperature. At the particulate filter 14, a differential pressure sensor 24 is attached for detecting a differential pressure before and after the particulate filter 14. Output signals of this temperature sensor 23, differential pressure sensor 24, and intake air amount detector 8 are input through respectively corresponding AD converters 37 to the input port 35. Further, an accelerator pedal 40 has a load sensor 41 connected to it which generates an output voltage proportional to the amount of depression L of the accelerator pedal 40. The output voltage of the load sensor 41 is input through a corresponding AD converter 37 to the input port 35. Furthermore, at the input port 35, a crank angle sensor 42 is connected which generates an output pulse every time a crankshaft rotates by, for example, 15°. On the other hand, the output port 36 is connected through corresponding drive circuits 38 to each fuel injector 3, a step motor for driving the throttle valve 10, hydrocarbon feed valve 15, EGR control valve 17, and fuel pump 21.

Figure 2:
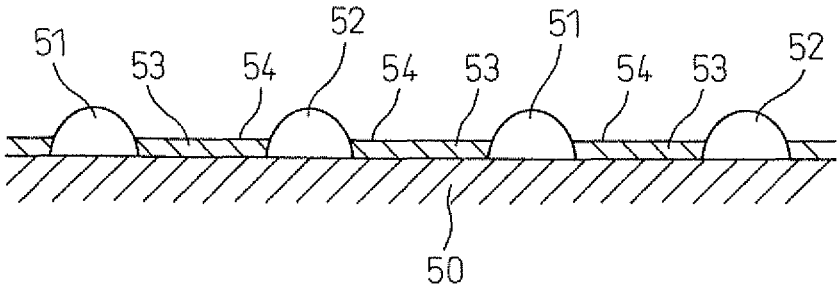
FIG. 2 is a view schematically showing a surface part of a catalyst carrier.

FIG. 2 schematically shows a surface part of a catalyst carrier which is carried on a substrate of the exhaust purification catalyst 13. At this exhaust purification catalyst 13, as shown in FIG. 2, for example, there is provided a catalyst carrier 50 made of alumina on which precious metal catalysts 51 and 52 are carried. Furthermore, on this catalyst carrier 50, a basic layer 53 is formed which includes at least one element selected from potassium K, sodium Na, cesium Cs, or another such alkali metal, barium Ba, calcium Ca, or another such alkali earth metal, a lanthanoid or another such rare earth and silver Ag, copper Cu, iron Fe, iridium Ir, or another metal able to donate electrons to $NO_x$. The exhaust gas flows along the top of the catalyst carrier 50, so the precious metal catalysts 51 and 52 can be said to be carried on the exhaust gas flow surface of the exhaust purification catalyst 13. Further, the surface of the basic layer 53 exhibits basicity, so the surface of the basic layer 53 is called the basic exhaust gas flow surface part 54.

On the other hand, in FIG. 2, the precious metal catalyst 51 is comprised of platinum Pt, while the precious metal catalyst 52 is comprised of rhodium Rh. That is, the precious metal catalysts 51 and 52 which are carried on the catalyst carrier 50 are comprised of platinum Pt and rhodium Rh. Note that, on the catalyst carrier 50 of the exhaust purification catalyst 13, in addition to platinum Pt and rhodium Rh, palladium Pd may be further carried or, instead of rhodium Rh, palladium Pd may be carried. That is, the precious metal catalysts 51 and 52 which are carried on the catalyst carrier 50 are comprised of platinum Pt and at least one of rhodium Rh and palladium Pd.

Figure 3:
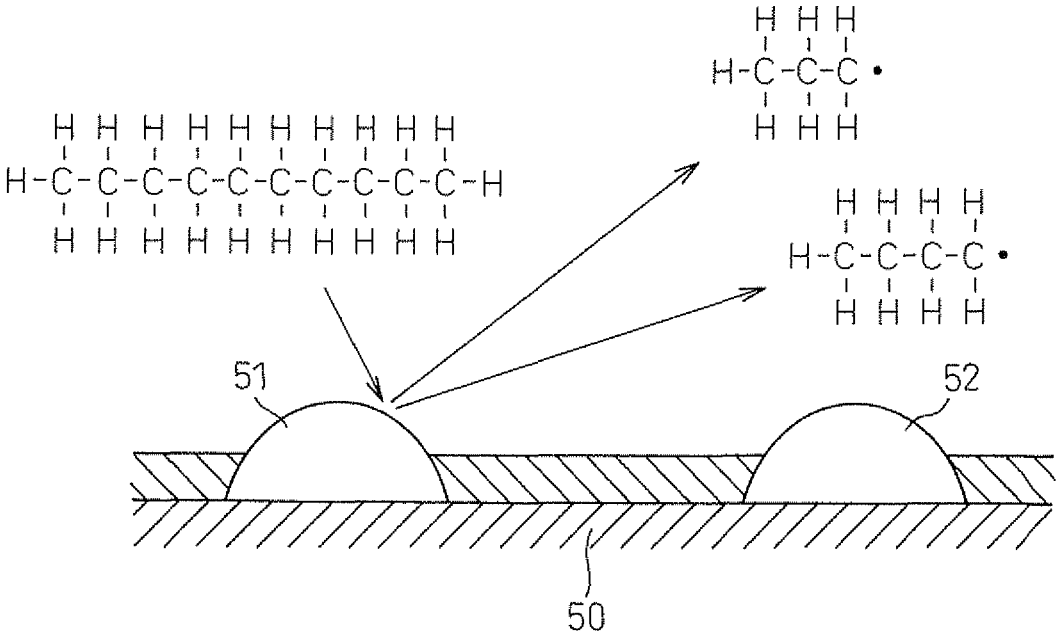
FIG. 3 is a view for explaining an oxidation reaction in an exhaust purification catalyst.

If hydrocarbons are injected from the hydrocarbon feed valve 15 into the exhaust gas, the hydrocarbons are reformed at the upstream side end of the exhaust purification catalyst 13. In the present invention, at this time, the reformed hydrocarbons are used to remove the $NO_x$ at the exhaust purification catalyst 13. FIG. 3 schematically shows the reforming action performed at the upstream end of the exhaust purification catalyst 13 at this time. As shown in FIG. 3, the hydrocarbons HC which are injected from the hydrocarbon feed valve 15 become radical hydrocarbons HC with a small carbon number by the catalyst 51.

Note that, even if injecting fuel, that is, hydrocarbons, from the fuel injector 3 into the combustion chamber 2 during the latter half of the expansion stroke or during the exhaust stroke, the hydrocarbons are reformed inside of the combustion chamber 2 or at the exhaust purification catalyst 13, and the $NO_x$ which is contained in the exhaust gas is removed by the reformed hydrocarbons at the exhaust purification catalyst 13. Therefore, in the present invention, instead of feeding hydrocarbons from the hydrocarbon feed valve 15 to the inside of the engine exhaust passage, it is also possible to feed hydrocarbons into the combustion chamber 2 during the latter half of the expansion stroke or during the exhaust stroke. In this way, in the present invention, it is also possible to feed hydrocarbons to the inside of the combustion chamber 2, but below the present invention is explained taking as an example the case of injecting hydrocarbons from the hydrocarbon feed valve 15 to the inside of the engine exhaust passage.

Figure 4:
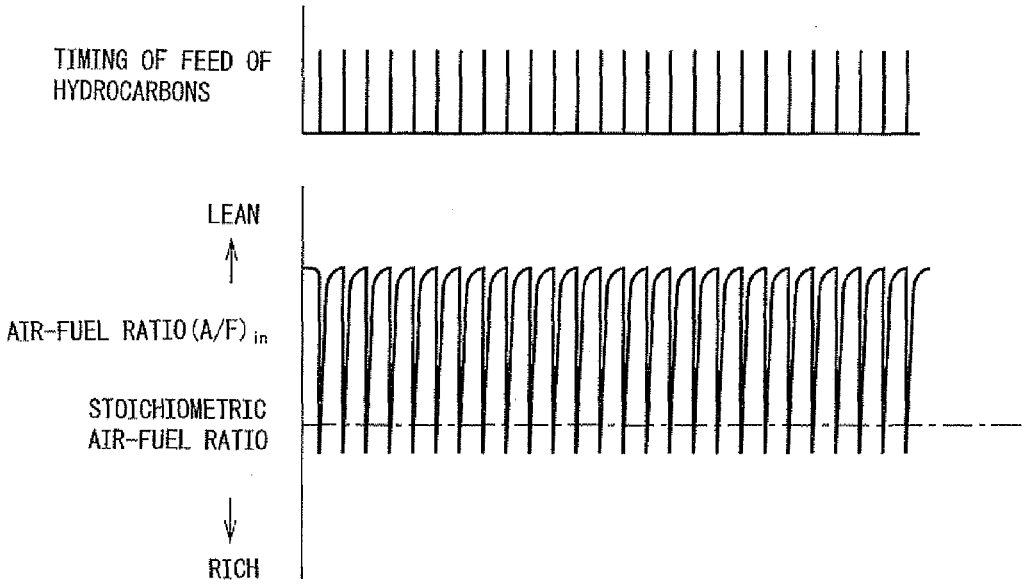
FIG. 4 is a view showing a change of an air-fuel ratio of exhaust gas flowing into an exhaust purification catalyst.

FIG. 4 shows the timing of feeding hydrocarbons from the hydrocarbon feed valve 15 and the changes in the air-fuel ratio (A/F)in of the exhaust gas flowing into the exhaust purification catalyst 13. Note that, the changes in the air-fuel ratio (A/F)in depend on the change in concentration of the hydrocarbons in the exhaust gas which flows into the exhaust purification catalyst 13, so it can be said that the change in the air-fuel ratio (A/F)in shown in FIG. 4 expresses the change in concentration of the hydrocarbons. However, if the hydrocarbon concentration becomes higher, the air-fuel ratio (A/F)in becomes smaller, so, in FIG. 4, the more to the rich side the air-fuel ratio (A/F)in becomes, the higher the hydrocarbon concentration.

Figure 5:
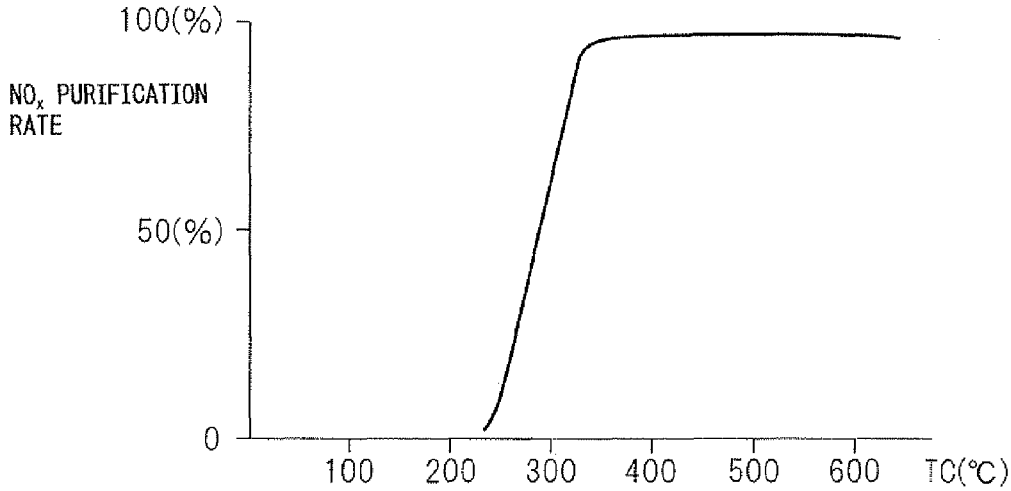
FIG. 5 is a view showing an $NO_x$ purification rate.

FIG. 5 shows the $NO_x$ purification rate by the exhaust purification catalyst 13 with respect to the catalyst temperatures TC of the exhaust purification catalyst 13 when periodically making the concentration of hydrocarbons flowing into the exhaust purification catalyst 13 change so as to, as shown in FIG. 4, make the air-fuel ratio (A/F)in of the exhaust gas flowing to the exhaust purification catalyst 13 change. The inventors engaged in research relating to $NO_x$ purification for a long time. In the process of research, they learned that if making the concentration of hydrocarbons flowing into the exhaust purification catalyst 13 vibrate by within a predetermined range of amplitude and within a predetermined range of period, as shown in FIG. 5, an extremely high $NO_x$ purification rate is obtained even in a 400° C. or higher high temperature region.

Figure 6A:
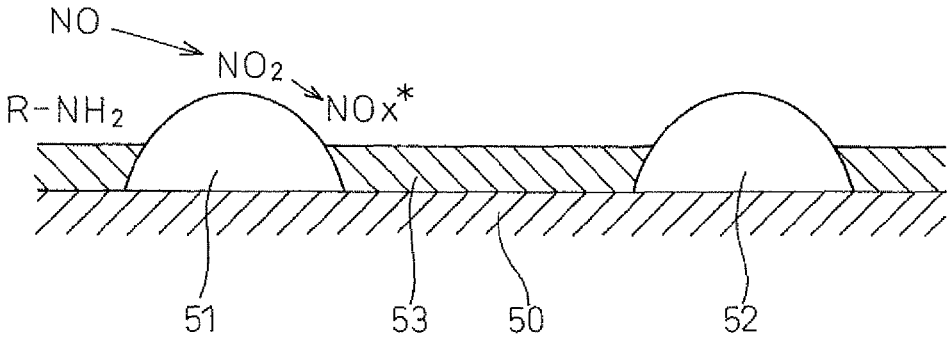
FIGS. 6A, 6B, and 6C are views for explaining an oxidation reduction reaction in an exhaust purification catalyst.
Figure 6B:
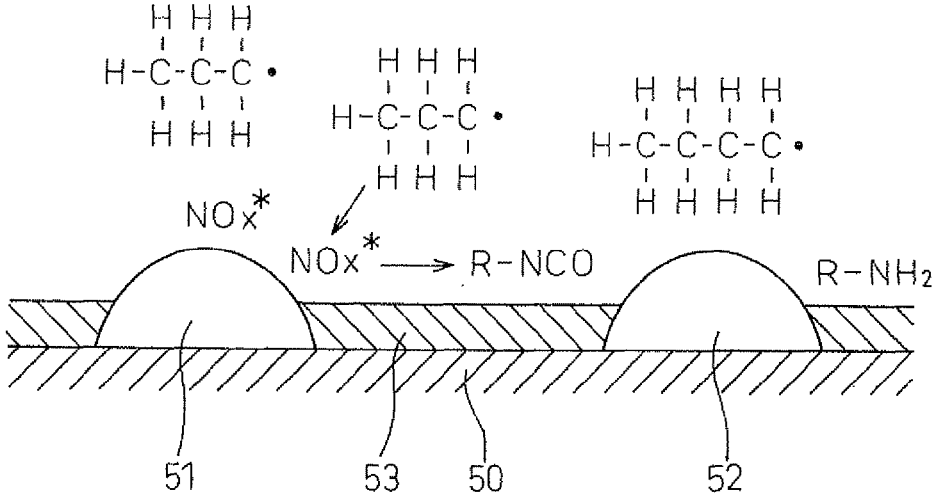
Figure 6C:
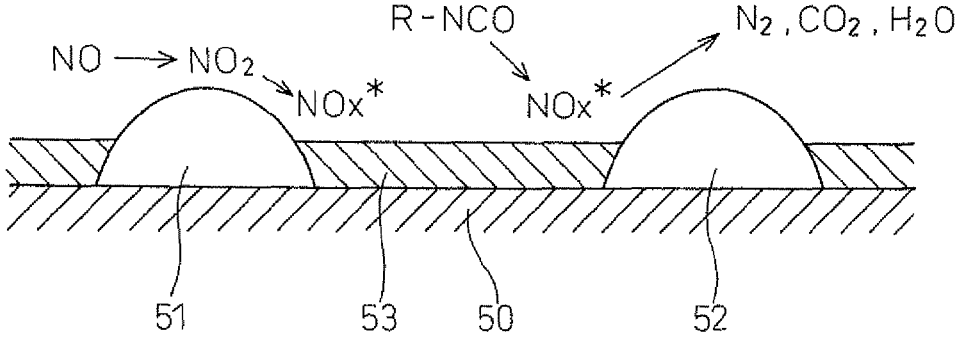

Furthermore, at this time, a large amount of reducing intermediate containing nitrogen and hydrocarbons is produced on the surface of the basic layer 53 of the upstream-side end of the exhaust purification catalyst 13, that is, on the basic exhaust gas flow surface part 54 of the upstream-side end of the exhaust purification catalyst 13. It is learned that this reducing intermediate plays a central role in obtaining a high $NO_x$ purification rate. Next, this will be explained with reference to FIGS. 6A, 6B, and 6C. Note that, FIGS. 6A and 6B schematically show the surface part of the catalyst carrier 50 of the upstream-side end of the exhaust purification catalyst 13, while FIG. 6C schematically shows the surface part of the catalyst carrier 50 at the downstream side from this upstream-side end. These FIGS. 6A, 6B, and 6C show the reaction which is presumed to occur when the concentration of hydrocarbons flowing into the exhaust purification catalyst 13 is made to vibrate by within a predetermined range of amplitude and within a predetermined range of period.

FIG. 6A shows when the concentration of hydrocarbons flowing into the exhaust purification catalyst 13 is low, while FIG. 6B shows when hydrocarbons are fed from the hydrocarbon feed valve 15 and the concentration of hydrocarbons flowing into the exhaust purification catalyst 13 becomes higher.

Now, as will be understood from FIG. 4, the air-fuel ratio of the exhaust gas which flows into the exhaust purification catalyst 13 is maintained lean except for an instant, so the exhaust gas which flows into the exhaust purification catalyst 13 normally becomes a state of oxygen excess. Therefore, the NO which is contained in the exhaust gas, as shown in FIG. 6A, is oxidized on the platinum 51 and becomes $NO_2$. Next, this $NO_2$ is further oxidized and becomes $NO_3$. Further, part of the $NO_2$ becomes $NO_2^-$. In this case, the amount of production of $NO_3$ is far greater than the amount of production of $NO_2^-$. Therefore, a large amount of $NO_3$ and a small amount of $NO_2^-$ are produced on the platinum 51. This $NO_3$ and $NO_2^-$ are strong in activity. Below, these $NO_3$ and $NO_2^-$ will be called the active $NO_2$*.

On the other hand, if hydrocarbons are fed from the hydrocarbon feed valve 15, as shown in FIG. 3, the hydrocarbons are reformed in the upstream-side end of the exhaust purification catalyst 13 and become radicalized. As a result, as shown in FIG. 6B, the hydrocarbon concentration around the active $NO_x$* becomes higher. In this regard, after the active $NO_x$* is produced, if the state of a high oxygen concentration around the active $NO_x$* continues for a predetermined time or more, the active $NO_x$* is oxidized and is absorbed in the basic layer 53 in the form of nitrate ions $NO_3^-$. However, if the hydrocarbon concentration around the active $NO_x$* is made higher before this predetermined time passes, as shown in FIG. 6B, the active $NO_x$* reacts on the platinum 51 with the radical hydrocarbons HC, whereby a reducing intermediate R—$NH_2$ is produced. This reducing intermediate R—$NH_2$ is adhered or adsorbed on the surface of the basic layer 53 while moving to the downstream side.

Note that, at this time, the first produced reducing intermediate is considered to be a nitro compound R—$NO_2$. If this nitro compound R—$NO_2$ is produced, the result becomes a nitrile compound R—CN, but this nitrile compound R—CN can only survive for an instant in this state, so immediately becomes an isocyanate compound R—NCO. This isocyanate compound R—NCO, when hydrolyzed, becomes an amine compound R—$NH_2$. However, in this case, what is hydrolyzed is considered to be part of the isocyanate compound R—NCO. Therefore, as shown in FIG. 6B, the majority of the reducing intermediate which is held or adsorbed on the surface of the basic layer 53 is believed to be the isocyanate compound R—NCO and amine compound R—$NH_2$.

On the other hand, part of the active $NO_3$* which is produced in the upstream-side end of the exhaust purification catalyst 13 is sent to the downstream side where it sticks to or is adsorbed at the surface of the basic layer 53. Therefore, a larger amount of $NO_x$* is held in the downstream side of the exhaust purification catalyst 1 as compared with the upstream-side end. On the other hand, as explained above, inside the exhaust purification catalyst 13, the reducing intermediate moves from the upstream-side end toward the downstream side. These reducing intermediate R—NCO or R—$NH_2$, as shown in FIG. 6C, reacts with the active $NO_x$* which is held inside the downstream side exhaust purification catalyst 13 to become $N_2$, $CO_2$, and $H_2O$ whereby the $NO_x$ is removed.

In this way, in the exhaust purification catalyst 13, the concentration of hydrocarbons which flow into the exhaust purification catalyst 13 is temporarily made high to generate the reducing intermediate so that the active $NO_x$* reacts with the reducing intermediate and the $NO_x$ is purified. That is, to use the exhaust purification catalyst 13 to remove the $NO_x$, it is necessary to periodically change the concentration of hydrocarbons flowing into the exhaust purification catalyst 13.

Of course, in this case, it is necessary to raise the concentration of hydrocarbons to a concentration sufficiently high for producing the reducing intermediate. That is, it is necessary to make the concentration of hydrocarbons flowing into the exhaust purification catalyst 13 vibrate by within a predetermined range of amplitude. Note that, in this case, it is necessary to hold a sufficient amount of reducing intermediate R—NCO or R—$NH_2$ on the basic layer 53, that is, the basic exhaust gas flow surface part 24, until the produced reducing intermediate reacts with the active $NO_x$*. For this reason, the basic exhaust gas flow surface part 24 is provided.

On the other hand, if lengthening the feed period of the hydrocarbons, the time in which the oxygen concentration becomes higher becomes longer in the period after the hydrocarbons are fed until the hydrocarbons are next fed. Therefore, the active $NO_x$* is absorbed in the basic layer 53 in the form of nitrates without producing a reducing intermediate. To avoid this, it is necessary to make the concentration of hydrocarbons flowing into the exhaust purification catalyst 13 vibrate by within a predetermined range of period.

Therefore, in an embodiment of the present invention, to make the $NO_x$ contained in the exhaust gas and the reformed hydrocarbons react and produce the reducing intermediate R—NCO or R—$NH_2$ containing nitrogen and hydrocarbons, precious metal catalysts 51 and 52 are carried on the exhaust gas flow surface of the exhaust purification catalyst 13. To hold the produced reducing intermediate R—NCO or R—$NH_2$ inside the exhaust purification catalyst 13, a basic exhaust gas flow surface part 54 is formed around the precious metal catalysts 51 and 52. $NO_x$ is reduced by the reducing action of the reducing intermediate R—NCO or R—$NH_2$ held on the basic exhaust gas flow surface part 54, and the vibration period of the hydrocarbon concentration is made the vibration period required for continuation of the production of the reducing intermediate R—NCO or R—$NH_2$. Incidentally, in the example shown in FIG. 4, the injection interval is made 3 seconds.

Figure 7A:
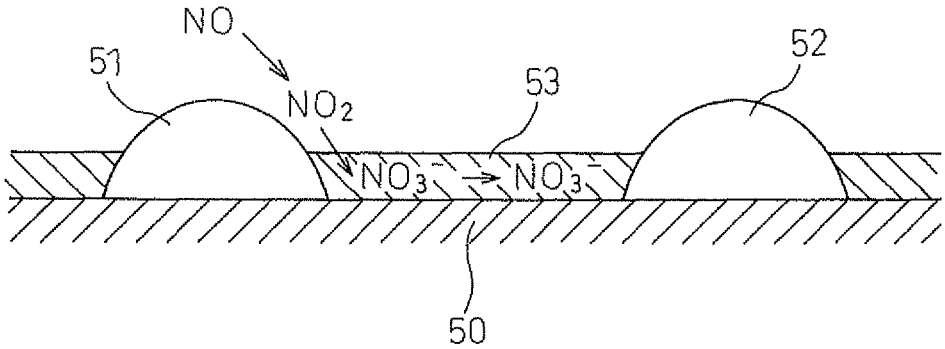
FIGS. 7A and 7B are views for explaining an oxidation reduction reaction in an exhaust purification catalyst.

If the vibration period of the hydrocarbon concentration, that is, the feed period of the hydrocarbons HC, is made longer than the above predetermined range of period, the reducing intermediate R—NCO or R—$NH_2$ disappears from the surface of the basic layer 53. At this time, the active $NO_x$* which is produced on the platinum Pt 53, as shown in FIG. 7A, diffuses in the basic layer 53 in the form of nitrate ions $NO_3^-$ and becomes nitrates. That is, at this time, the $NO_x$ in the exhaust gas is absorbed in the form of nitrates inside of the basic layer 53.

Figure 7B:
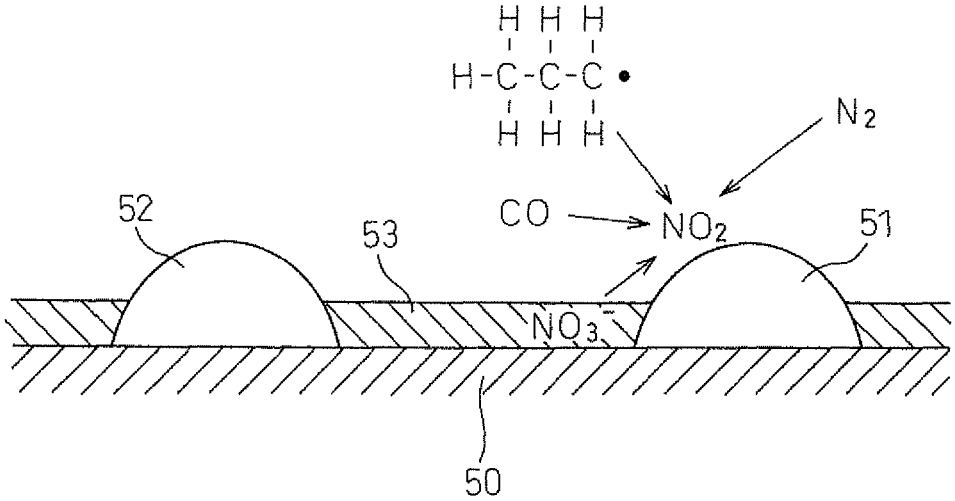

On the other hand, FIG. 7B shows the case where the air-fuel ratio of the exhaust gas which flows into the exhaust purification catalyst 13 is made the stoichiometric air-fuel ratio or rich when the $NO_x$ is absorbed in the form of nitrates inside of the basic layer 53. In this case, the oxygen concentration in the exhaust gas falls, so the reaction proceeds in the opposite direction ($NO_3^- \rightarrow NO_2$), and consequently the nitrates absorbed in the basic layer 53 become nitrate ions $NO_3^-$ one by one and, as shown in FIG. 7B, are released from the basic layer 53 in the form of $NO_2$. Next, the released $NO_2$ is reduced by the hydrocarbons HC and CO contained in the exhaust gas.

Figure 8:
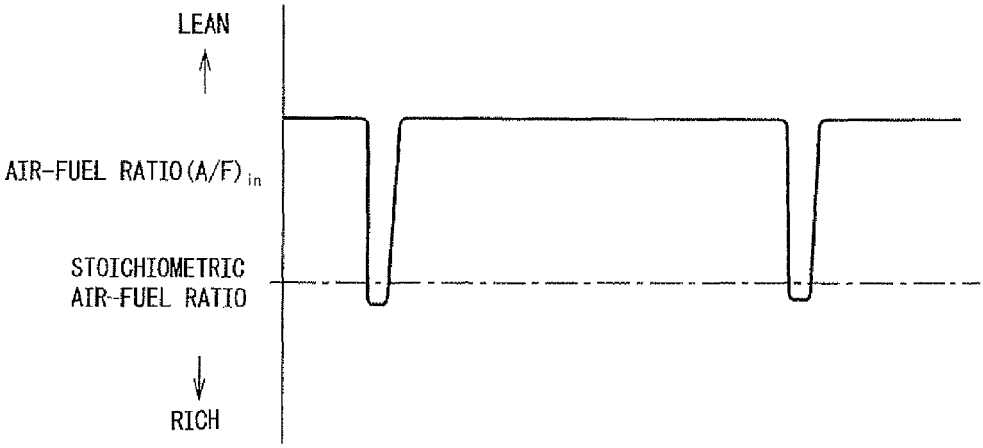
FIG. 8 is a view showing a change of an air-fuel ratio of exhaust gas flowing into an exhaust purification catalyst.

FIG. 8 shows the case of making the air-fuel ratio (A/F)in of the exhaust gas which flows into the exhaust purification catalyst 13 temporarily rich slightly before the $NO_x$ absorption ability of the basic layer 53 becomes saturated. Note that, in the example shown in FIG. 8, the time interval of this rich control is 1 minute or more. In this case, the $NO_x$ which was absorbed in the basic layer 53 when the air-fuel ratio (A/F)in of the exhaust gas was lean is released all at once from the basic layer 53 and reduced when the air-fuel ratio (A/F)in of the exhaust gas is made temporarily rich. Therefore, in this case, the basic layer 53 plays the role of an absorbent for temporarily absorbing $NO_x$.

Note that, at this time, sometimes the basic layer 53 temporarily adsorbs the $NO_x$. Therefore, if using term of storage as a term including both absorption and adsorption, at this time, the basic layer 53 performs the role of an $NO_x$ storage agent for temporarily storing the $NO_x$. That is, in this case, if the ratio of the air and fuel (hydrocarbons) which are supplied into the engine intake passage, combustion chambers 2, and exhaust passage upstream of the exhaust purification catalyst 13 is referred to as the air-fuel ratio of the exhaust gas, the exhaust purification catalyst 13 functions as an $NO_x$ storage catalyst which stores the $NO_x$ when the air-fuel ratio of the exhaust gas is lean and releases the stored $NO_x$ when the oxygen concentration in the exhaust gas falls.

Figure 9:
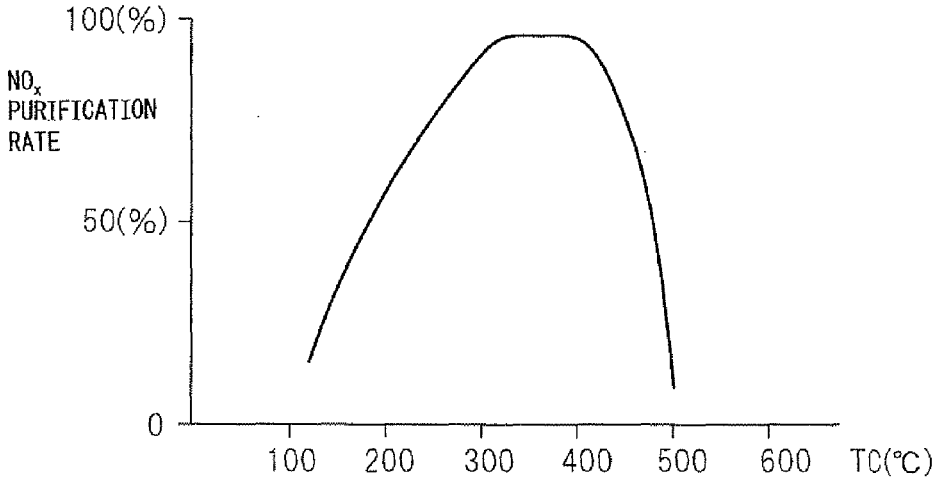
FIG. 9 is a view of an $NO_x$ purification rate.

FIG. 9 shows the $NO_x$ purification rate when making the exhaust purification catalyst 13 function as an $NO_x$ storage catalyst in this way. Note that, the abscissa of the FIG. 9 shows the catalyst temperature TC of the exhaust purification catalyst 13. When making the exhaust purification catalyst 13 function as an $NO_x$ storage catalyst, as shown in FIG. 9, when the catalyst temperature TO is 300° C. to 400° C., an extremely high $NO_x$ purification rate is obtained, but when the catalyst temperature TC becomes a 400° C. or higher high temperature, the $NO_x$ purification rate falls.

In this way, when the catalyst temperature TC becomes 400° C. or more, the $NO_x$ purification rate falls because if the catalyst temperature TC becomes 400° C. or more, the nitrates break down by heat and are released in the form of $NO_2$ from the exhaust purification catalyst 13. That is, so long as storing $NO_x$ in the form of nitrates, when the catalyst temperature TC is high, it is difficult to obtain a high $NO_x$ purification rate. However, in the new $NO_x$ purification method shown from FIG. 4 to FIGS. 6A and 6B, as will be understood from FIGS. 6A and 6B, nitrates are not formed or even if formed are extremely fine in amount, consequently, as shown in FIG. 5, even when the catalyst temperature TC is high, a high $NO_x$ purification rate is obtained.

Therefore, in the present invention, an exhaust purification catalyst 13 for reacting $NO_x$ contained in exhaust gas and reformed hydrocarbons to produce a reducing intermediate containing nitrogen and hydrocarbons is arranged in the engine exhaust passage, precious metal catalysts 51 and 52 are carried on the exhaust gas flow surface of the exhaust purification catalyst 13, a basic exhaust gas flow surface part 54 is formed around the precious metal catalysts 51 and 52, the exhaust purification catalyst 13 has the property of producing the reducing intermediate and reducing the $NO_x$ contained in exhaust gas by the reducing action of the produced reducing intermediate if the concentration of hydrocarbons flowing into the exhaust purification catalyst 13 is made to vibrate within a predetermined range of amplitude and within a predetermined range of period and has the property of being increased in storage amount of $NO_x$ which is contained in exhaust gas if the vibration period of the hydrocarbon concentration is made longer than this predetermined range, and, at the time of engine operation, the concentration of hydrocarbons flowing into the exhaust purification catalyst 13 is made to vibrate within the predetermined range of amplitude and with the predetermined range of period to thereby reduce the $NO_x$ which is contained in the exhaust gas in the exhaust purification catalyst 13.

That is, the $NO_x$ purification method which is shown from FIG. 4 to FIGS. 6A and 6B can be said to be a new $NO_x$ purification method designed to remove $NO_x$ without forming almost any nitrates in the case of using an exhaust purification catalyst which carries a precious metal catalyst and forms a basic layer which can absorb $NO_x$. In actuality, when using this new $NO_x$ purification method, the nitrates which are detected from the basic layer 53 become much smaller in amount compared with the case where making the exhaust purification catalyst 13 function as an $NO_x$ storage catalyst. Note that, this new $NO_x$ purification method will be referred to below as the first $NO_x$ purification method.

Next, referring to FIG. 10 to FIG. 15, this first $NO_x$ purification method will be explained in a bit more detail.

Figure 10:
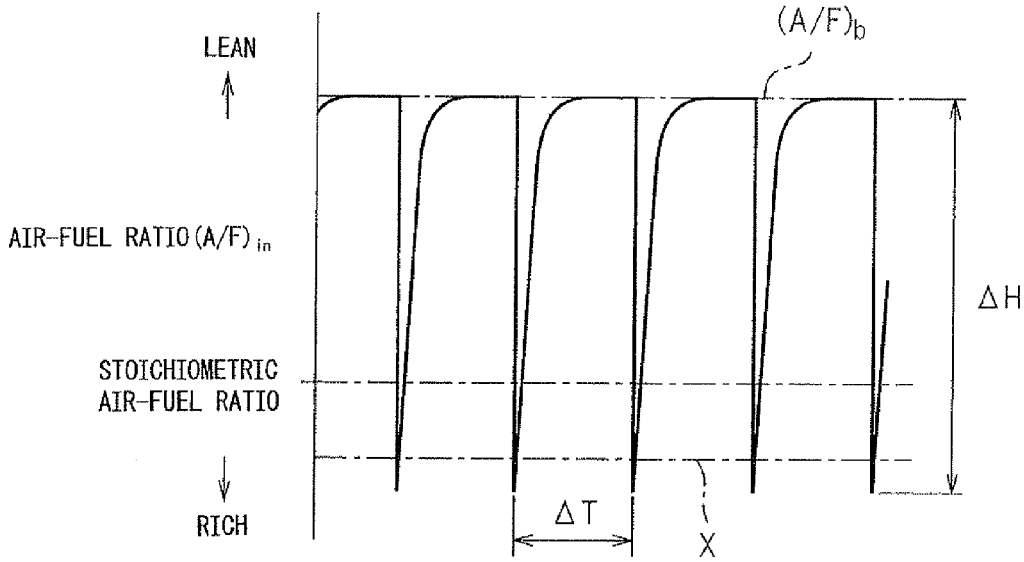
FIG. 10 is a time chart showing a change of an air-fuel ratio of exhaust gas flowing into an exhaust purification catalyst.

FIG. 10 shows enlarged the change in the air-fuel ratio (A/F)in shown in FIG. 4. Note that, as explained above, the change in the air-fuel ratio (A/F)in of the exhaust gas flowing into this exhaust purification catalyst 13 simultaneously shows the change in concentration of the hydrocarbons which flow into the exhaust purification catalyst 13. Note that, in FIG. 10, ΔH shows the amplitude of the change in concentration of hydrocarbons HC which flow into the exhaust purification catalyst 13, while ΔT shows the vibration period of the concentration of the hydrocarbons which flow into the exhaust purification catalyst 13.

Furthermore, in FIG. 10, (A/F)b shows the base air-fuel ratio which shows the air-fuel ratio of the combustion gas for generating the engine output. In other words, this base air-fuel ratio (A/F)b shows the air-fuel ratio of the exhaust gas which flows into the exhaust purification catalyst 13 when stopping the feed of hydrocarbons. On the other hand, in FIG. 10, X shows the upper limit of the air-fuel ratio (A/F)in used for producing the reducing intermediate without the produced active $NO_x$* being stored in the form of nitrates inside the basic layer 53 much at all. To make the active $NO_x$* and the reformed hydrocarbons react to produce a reducing intermediate, the air-fuel ratio (A/F)in has to be made lower than this upper limit X of the air-fuel ratio.

In other words, in FIG. 10, X shows the lower limit of the concentration of hydrocarbons required for making the active $NO_x$* and reformed hydrocarbon react to produce a reducing intermediate. To produce the reducing intermediate, the concentration of hydrocarbons has to be made higher than this lower limit X. In this case, whether the reducing intermediate is produced is determined by the ratio of the oxygen concentration and hydrocarbon concentration around the active $NO_x$*, that is, the air-fuel ratio (A/F)in. The upper limit X of the air-fuel ratio required for producing the reducing intermediate will below be called the demanded minimum air-fuel ratio.

In the example shown in FIG. 10, the demanded minimum air-fuel ratio X is rich, therefore, in this case, to form the reducing intermediate, the air-fuel ratio (A/F)in is instantaneously made the demanded minimum air-fuel ratio X or less, that is, rich. As opposed to this, in the example shown in FIG. 11, the demanded minimum air-fuel ratio X is lean. In this case, the air-fuel ratio (A/F)in is maintained lean while periodically reducing the air-fuel ratio (A/F)in so as to form the reducing intermediate.

In this case, whether the demanded minimum air-fuel ratio X becomes rich or becomes lean depends on the oxidizing strength of the exhaust purification catalyst 13. In this case, the exhaust purification catalyst 13, for example, becomes stronger in oxidizing strength if increasing the carried amount of the precious metal 51 and becomes stronger in oxidizing strength if strengthening the acidity. Therefore, the oxidizing strength of the exhaust purification catalyst 13 changes due to the carried amount of the precious metal 51 or the strength of the acidity.

Figure 11:
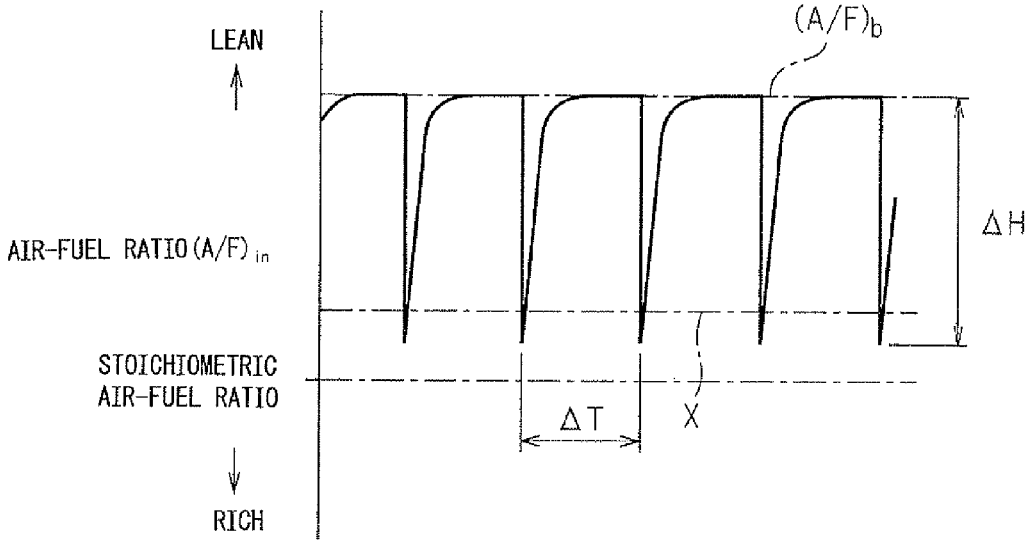
FIG. 11 is a time chart showing a change of an air-fuel ratio of exhaust gas flowing into an exhaust purification catalyst.

Now, if using an exhaust purification catalyst 13 with a strong oxidizing strength, as shown in FIG. 11, if maintaining the air-fuel ratio (A/F)in lean while periodically lowering the air-fuel ratio (A/F)in, the hydrocarbons end up becoming completely oxidized when the air-fuel ratio (A/F)in is reduced. As a result, the reducing intermediate can no longer be produced. As opposed to this, when using an exhaust purification catalyst 13 with a strong oxidizing strength, as shown in FIG. 10, if making the air-fuel ratio (A/F)in periodically rich, when the air-fuel ratio (A/F)in is made rich, the hydrocarbons will be partially oxidized, without being completely oxidized, that is, the hydrocarbons will be reformed, consequently the reducing intermediate will be produced. Therefore, when using an exhaust purification catalyst 13 with a strong oxidizing strength, the demanded minimum air-fuel ratio X has to be made rich.

On the other hand, when using an exhaust purification catalyst 13 with a weak oxidizing strength, as shown in FIG. 11, if maintaining the air-fuel ratio (A/F)in lean while periodically lowering the air-fuel ratio (A/F)in, the hydrocarbons will be partially oxidized without being completely oxidized, that is, the hydrocarbons will be reformed and consequently the reducing intermediate will be produced. As opposed to this, when using an exhaust purification catalyst 13 with a weak oxidizing strength, as shown in FIG. 10, if making the air-fuel ratio (A/F)in periodically rich, a large amount of hydrocarbons will be exhausted from the exhaust purification catalyst 13 without being oxidized and consequently the amount of hydrocarbons which is wastefully consumed will increase. Therefore, when using an exhaust purification catalyst 13 with a weak oxidizing strength, the demanded minimum air-fuel ratio X has to be made lean.

Figure 12:
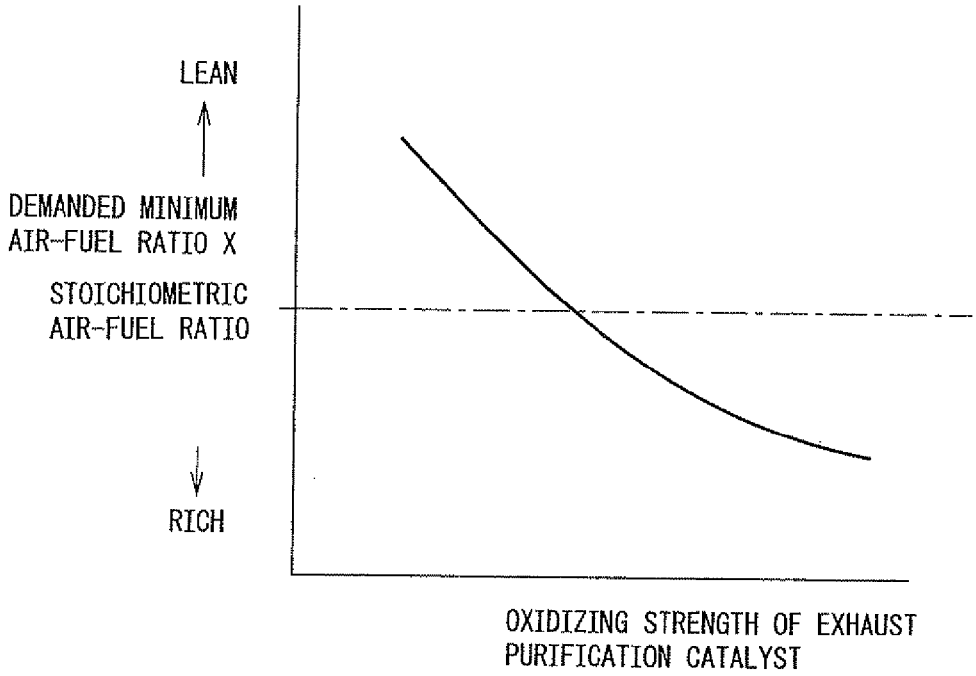
FIG. 12 is a view showing a relationship between an oxidizing strength of an exhaust purification catalyst and a demanded minimum air-fuel ratio X.

That is, it is learned that the demanded minimum air-fuel ratio X, as shown in FIG. 12, has to be reduced the stronger the oxidizing strength of the exhaust purification catalyst 13. In this way the demanded minimum air-fuel ratio X becomes lean or rich due to the oxidizing strength of the exhaust purification catalyst 13. Below, taking as example the case where the demanded minimum air-fuel ratio X is rich, the amplitude of the change in concentration of hydrocarbons flowing into the exhaust purification catalyst 13 and the vibration period of the concentration of hydrocarbons flowing into the exhaust purification catalyst 13 will be explained.

Now, if the base air-fuel ratio (A/F)b becomes larger, that is, if the oxygen concentration in the exhaust gas before the hydrocarbons are fed becomes higher, the feed amount of hydrocarbons required for making the air-fuel ratio (A/F)in the demanded minimum air-fuel ratio X or less increases. Therefore, the higher the oxygen concentration in the exhaust gas before the hydrocarbons are fed, the larger the amplitude of the hydrocarbon concentration has to be made.

Figure 13:
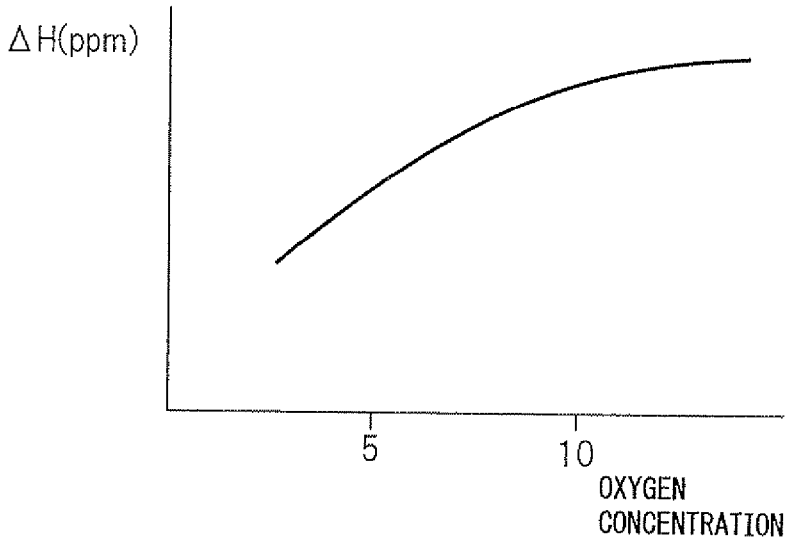
FIG. 13 is a view showing a relationship between an oxygen concentration in exhaust gas and an amplitude ΔH of a hydrocarbon concentration giving the same $NO_x$ purification rate.

FIG. 13 shows the relationship between the oxygen concentration in the exhaust gas before the hydrocarbons are fed and the amplitude ΔH of the hydrocarbon concentration when the same $NO_x$ purification rate is obtained. From FIG. 13, it is learned that to obtain the same $NO_x$ purification rate, the higher the oxygen concentration in the exhaust gas before the hydrocarbons are fed, the greater the amplitude ΔH of the hydrocarbon concentration has to be made. That is, to obtain the same $NO_x$ purification rate, the higher the base air-fuel ratio (A/F)b, the greater the amplitude ΔT of the hydrocarbon concentration has to be made. In other words, to remove the $NO_x$ well, the lower the base air-fuel ratio (A/F)b, the more the amplitude ΔT of the hydrocarbon concentration can be reduced.

Figure 14:
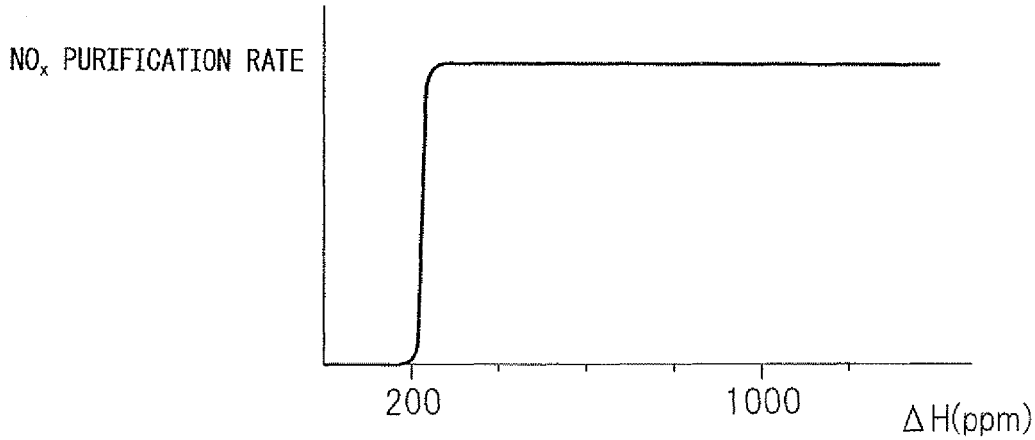
FIG. 14 is a view showing a relationship between an amplitude ΔH of a hydrocarbon concentration and an $NO_x$ purification rate.

In this regard, the base air-fuel ratio (A/F)b becomes the lowest at the time of an acceleration operation. At this time, if the amplitude ΔH of the hydrocarbon concentration is about 200 ppm, it is possible to remove the $NO_x$ well. The base air-fuel ratio (A/F)b is normally larger than the time of acceleration operation. Therefore, as shown in FIG. 14, if the amplitude ΔH of the hydrocarbon concentration is 200 ppm or more, an excellent $NO_x$ purification rate can be obtained.

On the other hand, it is learned that when the base air-fuel ratio (A/F)b is the highest, if making the amplitude ΔH of the hydrocarbon concentration 10000 ppm or so, an excellent $NO_x$ purification rate is obtained. Therefore, in the present invention, the predetermined range of the amplitude of the hydrocarbon concentration is made 200 ppm to 10000 ppm.

Figure 15:
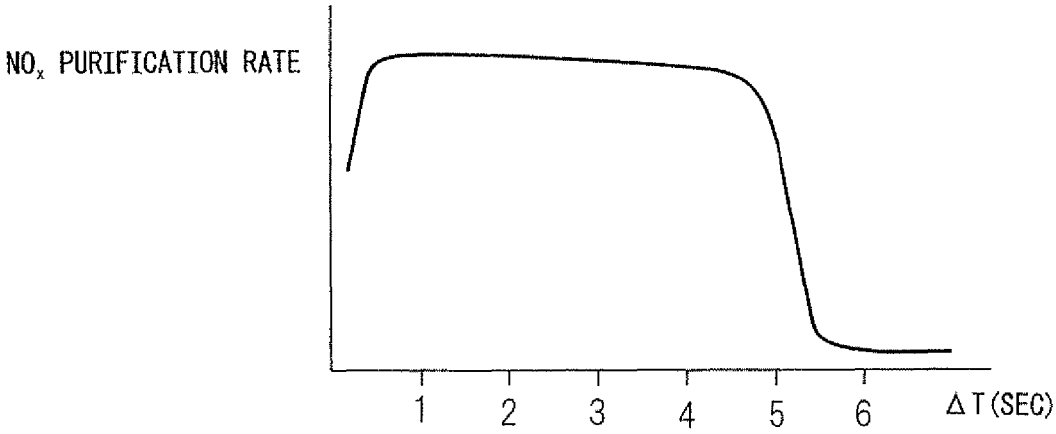
FIG. 15 is a view showing a relationship of a vibration period ΔT of a hydrocarbon concentration and an $NO_x$ purification rate.

Further, if the vibration period ΔT of the hydrocarbon concentration becomes longer, the oxygen concentration around the active $NO_x$* becomes higher in the time after the hydrocarbons are fed to when the hydrocarbons are next fed. In this case, if the vibration period ΔT of the hydrocarbon concentration becomes longer than about 5 seconds, the active $NO_x$* starts to be absorbed in the form of nitrates inside the basic layer 53. Therefore, as shown in FIG. 15, if the vibration period ΔT of the hydrocarbon concentration becomes longer than about 5 seconds, the $NO_x$ purification rate falls. Therefore, the vibration period ΔT of the hydrocarbon concentration has to be made 5 seconds or less.

On the other hand, if the vibration period ΔT of the hydrocarbon concentration becomes about 0.3 second or less, the fed hydrocarbons start to build up on the exhaust gas flow surface of the exhaust purification catalyst 13, therefore, as shown in FIG. 15, if the vibration period ΔT of the hydrocarbon concentration becomes about 0.3 second or less, the $NO_x$ purification rate falls. Therefore, in the present invention, the vibration period of the hydrocarbon concentration is made from 0.3 second to 5 seconds.

Figure 16:
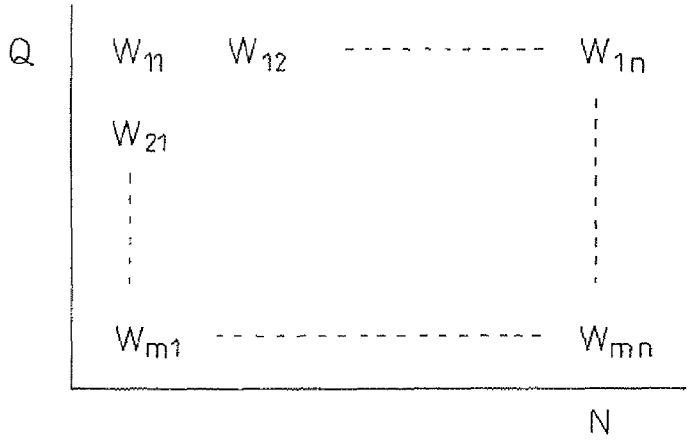
FIG. 16 is a view showing a map of the hydrocarbon feed amount W.

Now, in the present invention, by changing the hydrocarbon feed amount and injection timing from the hydrocarbon feed valve 15, the amplitude ΔH and vibration period ΔT of the hydrocarbons concentration are controlled so as to become the optimum values in accordance with the engine operating state. In this case, in this embodiment of the present invention, the hydrocarbon feed amount W able to give the optimum amplitude ΔH of the hydrocarbon concentration is stored as a function of the injection amount Q from the fuel injector 3 and engine speed N in the form of a map such as shown in FIG. 16 in advance in the ROM 32. Further, the optimum vibration amplitude ΔT of the hydrocarbon concentration, that is, the injection period ΔT of the hydrocarbons, is similarly stored as a function of the injection amount Q and engine speed N in the form of a map in advance in the ROM 32.

Next, referring to FIG. 17 to FIG. 20, an $NO_x$ purification method in the case when making the exhaust purification catalyst 13 function as an $NO_x$ storage catalyst will be explained in detail. The $NO_x$ purification method in the case when making the exhaust purification catalyst 13 function as an $NO_x$ storage catalyst in this way will be referred to below as the second $NO_x$ purification method.

Figure 17:
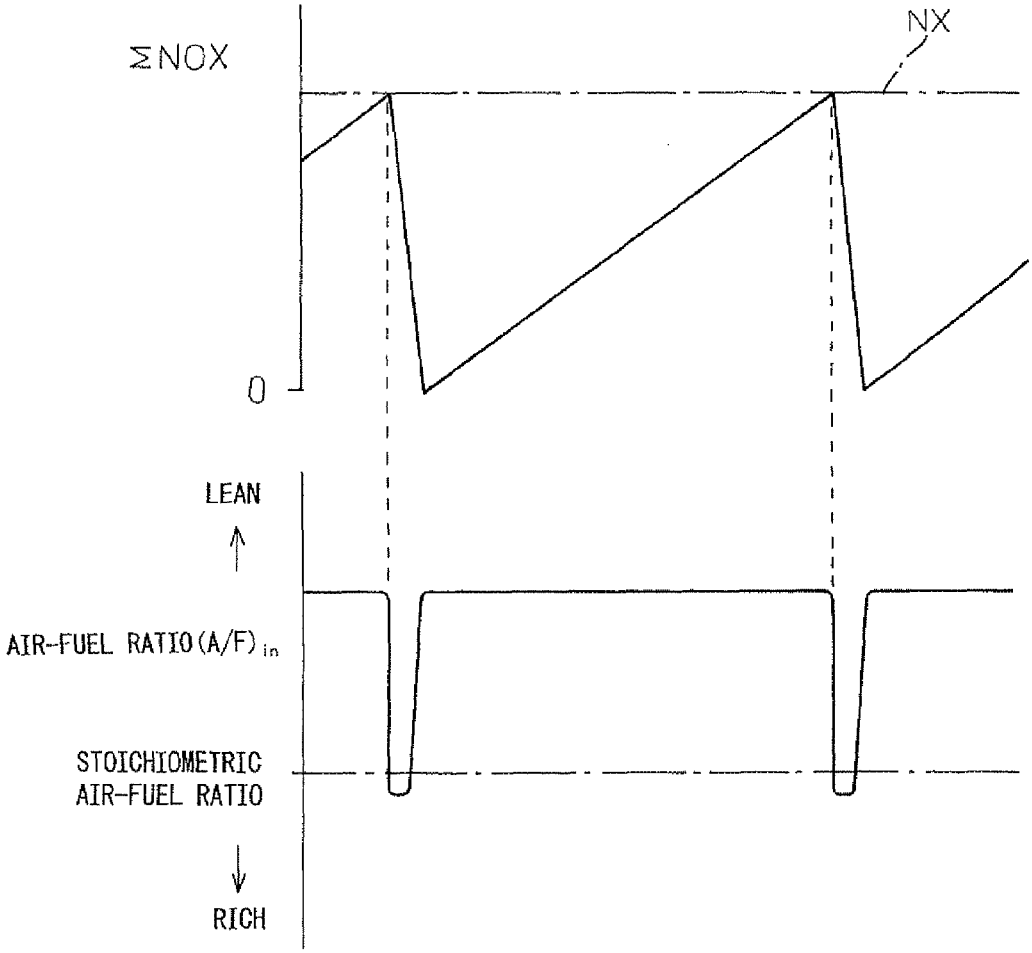
FIG. 17 is a view showing a change in the air-fuel ratio of the exhaust gas flowing to the exhaust purification catalyst etc.

In this second $NO_x$ purification method, as shown in FIG. 17, when the stored $NO_x$ amount ΣNOX of $NO_x$ which is stored in the basic layer 53 exceeds a predetermined allowable amount MAX, the air-fuel ratio (A/F)in of the exhaust gas flowing into the exhaust purification catalyst 13 is temporarily made rich. If the air-fuel ratio (A/F)in of the exhaust gas is made rich, the $NO_x$ which was stored in the basic layer 53 when the air-fuel ratio (A/F)in of the exhaust gas was lean is released from the basic layer 53 all at once and reduced. Due to this, the $NO_x$ is removed.

Figure 18:
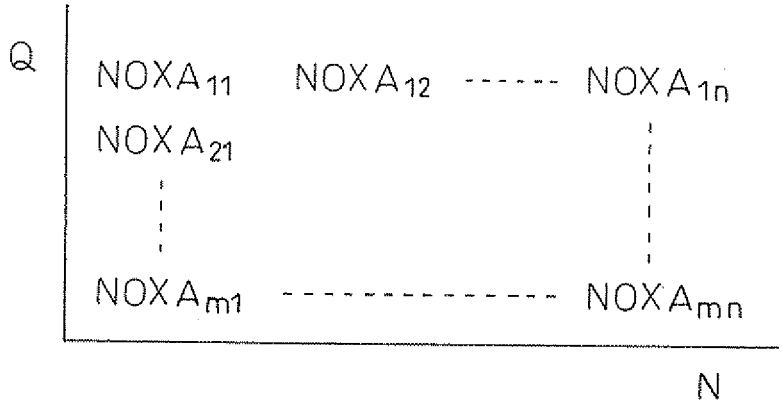
FIG. 18 is a view showing a map of an exhausted $NO_x$ amount NOXA.

The stored $NO_x$ amount ΣNOX is, for example, calculated from the amount of $NO_x$ which is exhausted from the engine. In this embodiment according to the present invention, the exhausted $NO_x$ amount NOXA of $NO_x$ which is exhausted from the engine per unit time is stored as a function of the injection amount Q and engine speed N in the form of a map such as shown in FIG. 18 in advance in the ROM 32. The stored $NO_x$ amount ΣNOX is calculated from exhausted $NO_x$ amount NOXA. In this case, as explained before, the period in which the air-fuel ratio (A/F)in of the exhaust gas is made rich is usually 1 minute or more.

Figure 19:
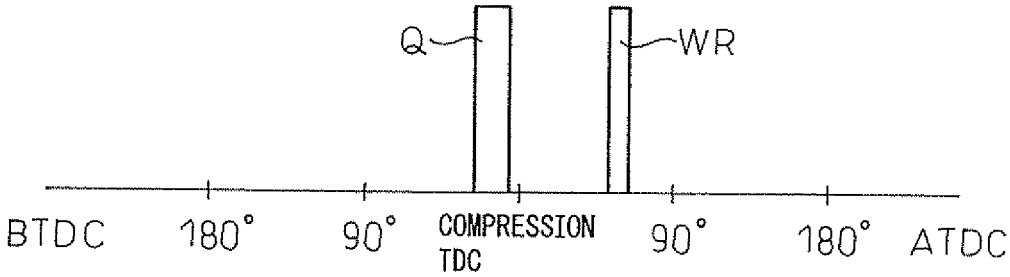
FIG. 19 is a view showing a fuel injection timing.
Figure 20:
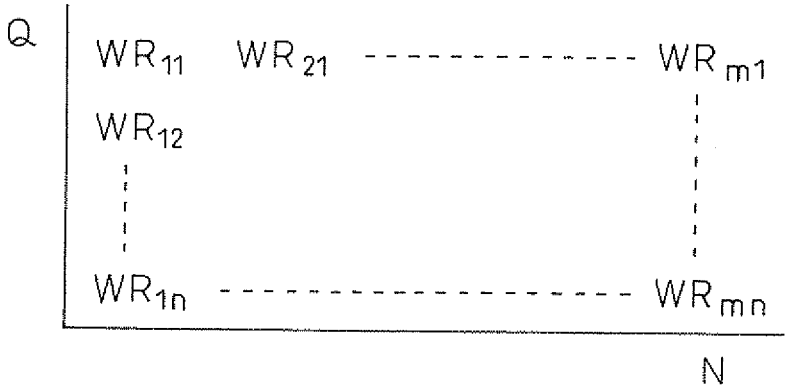
FIG. 20 is a view showing a map of a hydrocarbon feed amount WR.

In this second $NO_x$ purification method, as shown in FIG. 19, the fuel injector 3 injects additional fuel WR into the combustion chamber 2 in addition to the combustion-use fuel Q so that the air-fuel ratio (A/F)in of the exhaust gas flowing into the exhaust purification catalyst 13 is made rich. Note that, in FIG. 19, the abscissa indicates the crank angle. This additional fuel WR is injected at a timing at which it will burn, but will not appear as engine output, that is, slightly before ATDC90° after compression top dead center. This fuel amount WR is stored as a function of the injection amount Q and engine speed N in the form of a map such as shown in FIG. 20 in advance in the ROM 32. Of course, in this case, it is also possible to make the amount of feed of hydrocarbons from the hydrocarbon feed valve 15 increase so as to make the air-fuel ratio (A/F)in of the exhaust gas rich.

Figure 21A:
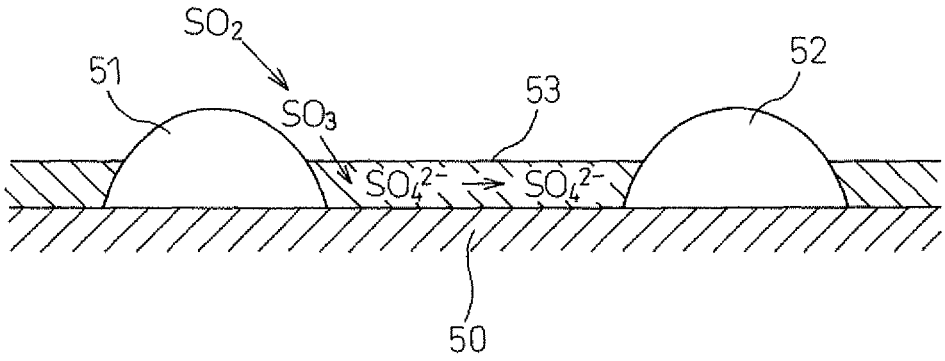
FIGS. 21A and 21B are views for explaining an $SO_x$ storage and release action.

In this regard, exhaust gas contains $SO_x$, that is, $SO_2$. If this $SO_2$ flows into the exhaust purification catalyst 13, this $SO_2$ is oxidized on the platinum Pt 51 and becomes $SO_3$ as show in FIG. 21A even when an $NO_x$ purification action is performed by the first $NO_x$ purification method and even when an $NO_x$ purification action is performed by the second $NO_x$ purification method. Next, this $SO_3$ is absorbed in the basic layer 53 and diffuses inside the basic layer 53 in the form of sulfate ions $SO_4^{2-}$ to thereby produce the stable sulfate. However, sulfates are stable and hard to break down. If just simply making the air-fuel ratio of the exhaust gas rich, the sulfates will remain as they are without breaking down. Therefore, inside the basic layer 53, along with the elapse of time, a gradually increasing amount of $SO_x$ will be stored. That is, the exhaust purification catalyst 13 will suffer from sulfur poisoning.

If the amount of $SO_x$ which is stored in the basic layer 53 increases, the basicity of the basic layer 53 weakens and, as a result, the reaction whereby the $NO_2$ becomes $NO_3$, that is, the reaction for producing active $NO_x$*, can no longer proceed. If the reaction for producing active $NO_x$* can no longer proceed in this way, the action of producing the reducing intermediate at the upstream-side end of the exhaust purification catalyst 13 becomes weaker and, therefore, the $NO_x$ purification rate falls when the $NO_x$ purification action is performed by the first $NO_x$ purification method. Therefore, at this time, it is necessary to make the $SO_x$ which is stored at the upstream-side end of the exhaust purification catalyst 13 be released from the upstream-side end.

On the other hand, even if the $SO_x$ amount which is stored in the basic layer 53 increases, there will be little effect on the reaction of the reducing intermediate and active $NO_x$* at the downstream side of the exhaust purification catalyst 13, that is, the $NO_x$ purification method. However, if the stored amount of $SO_x$ increases in the exhaust purification catalyst 13 as a whole, the amount of $NO_x$ which the exhaust purification catalyst 13 can store falls and finally $NO_x$ can no longer be stored. If the exhaust purification catalyst 13 can no longer store the $NO_x$ soon the second $NO_x$ purification method will no longer be able to be used to remove the $NO_x$. Therefore, in this case, it is necessary to make the $SO_x$ which is stored in the entirety of the exhaust purification catalyst 13 be released from the entirety of exhaust purification catalyst 13.

In this regard, in this case, if the reducing agent, that is, hydrocarbons, are fed in the state where the temperature of the exhaust purification catalyst 13 is made to rise to the $SO_x$ release temperature determined by the exhaust purification catalyst 13, and thereby the air-fuel ratio of the exhaust gas flowing into the exhaust purification catalyst 13 is made rich, $SO_x$ can be released from the exhaust purification catalyst 13 by the reducing action of the reducing agent.

However, the reducing power of hydrocarbons HC themselves is not that strong. Therefore, when releasing $SO_x$ from the exhaust purification catalyst 13, if using the reducing action of hydrocarbons HC to reduce the $SO_x$, a large amount of hydrocarbons HC becomes necessary. As opposed to this, ammonia $NH_3$ is far stronger in reducing ability compared with hydrocarbons HC. Therefore, if it were possible to produce ammonia $NH_3$ when releasing $SO_x$ from the exhaust purification catalyst 13, it would become easy to reduce the $SO_x$.

The inventors engaged in repeated research regarding this point and as a result discovered that when a reducing intermediate builds up inside the exhaust purification catalyst 13, if the air-fuel ratio of the exhaust gas flowing into the exhaust purification catalyst 13 is made rich, the reducing intermediate will desorb from the exhaust purification catalyst 13 in the form of ammonia and that the $SO_x$ which is stored in the exhaust purification catalyst 13 is reduced by this desorbed ammonia and released.

Therefore, in the present invention, when $SO_x$ which has been stored at the exhaust purification catalyst 13 should be released, the air-fuel ratio of the exhaust gas which flows into the exhaust purification catalyst 13 is lowered to the targeted rich air-fuel ratio to make the reducing intermediate built up on the exhaust purification catalyst 13 desorb in the form of ammonia and the desorbed ammonia is used to make the stored $SO_x$ be released from the exhaust purification catalyst.

Figure 21B:
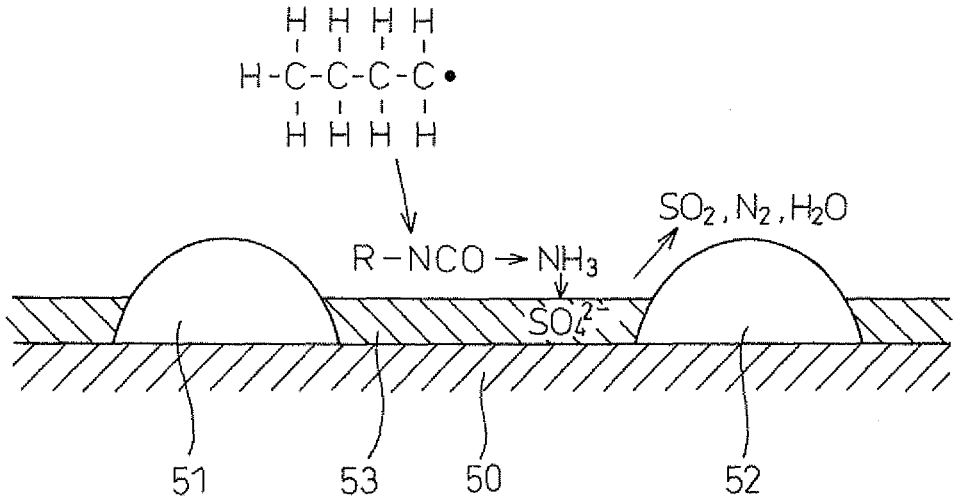

That is, at this time, as shown in FIG. 21B, the partially oxidized hydrocarbons and the reducing intermediate react whereby the reducing intermediate is made to desorb in the form of ammonia $NH_3$. The stored sulfates are reduced by this desorbed ammonia $NH_3$ and is released from the basic layer 53 in the form of $SO_2$.

Figure 22A:
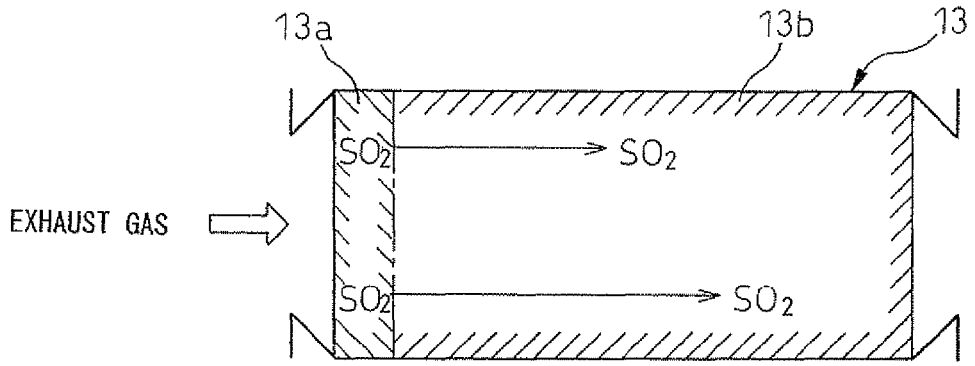
FIGS. 22A, 22B, and 22C are views for explaining $SO_x$ release control.
Figure 22B:
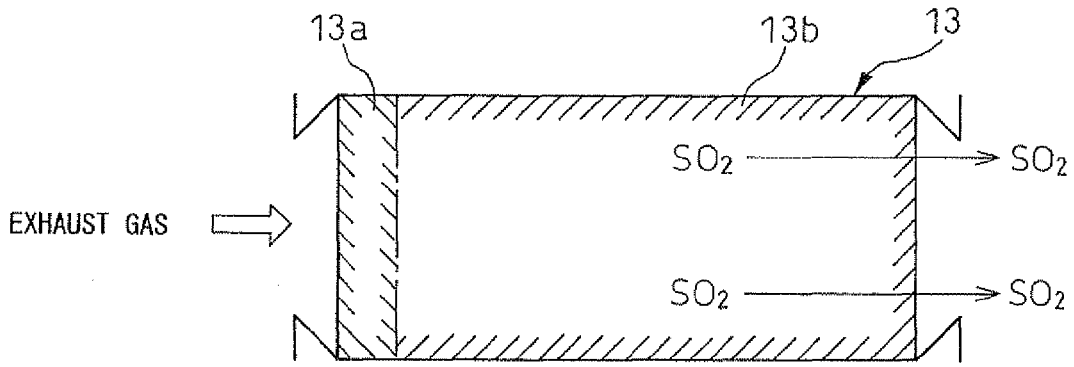
Figure 23A:
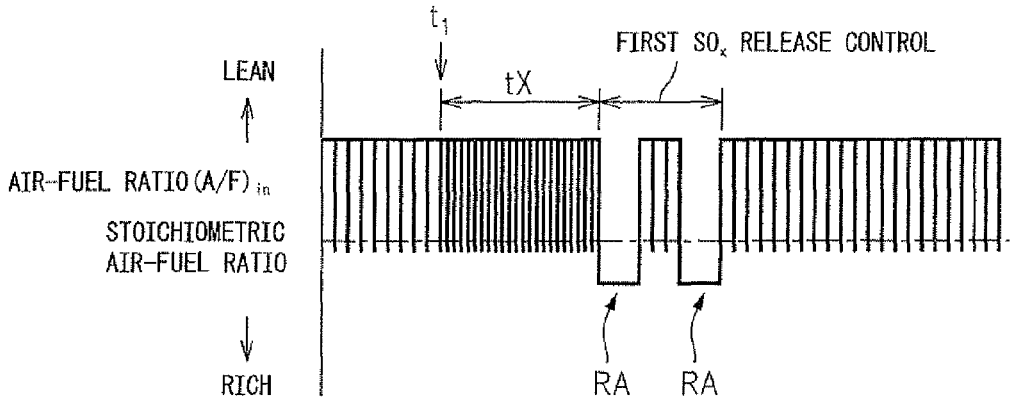
FIGS. 23A and 23B are views showing the change in the air-fuel ratio of exhaust gas flowing into an exhaust purification catalyst at the time of $SO_x$ release control.
Figure 23B:
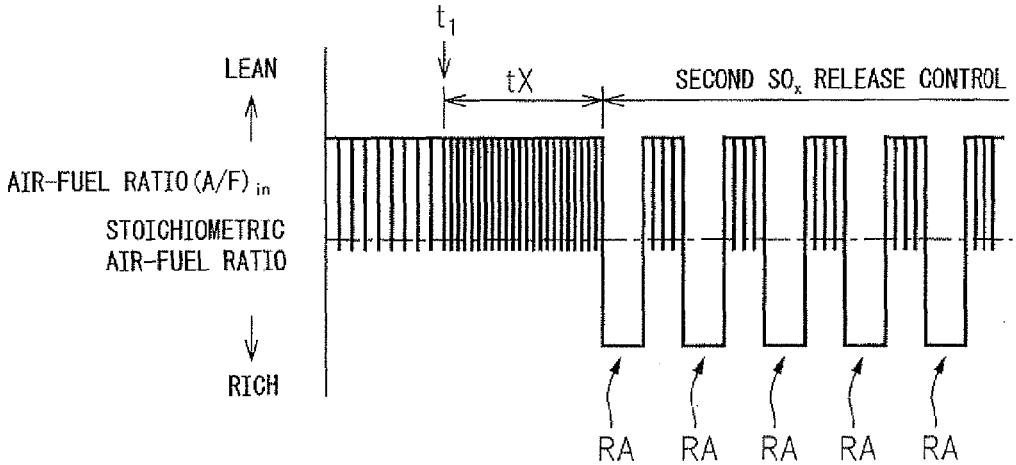

In this regard, in the present invention, as the $SO_x$ release control for releasing $SO_x$ from the exhaust purification catalyst 13, two $SO_x$ release controls comprised of a first $SO_x$ release control which uses the desorbed ammonia to release the stored $SO_x$ from the upstream-side end of the exhaust purification catalyst 13 and a second $SO_x$ release control which releases the stored $SO_x$ from the entirety of the exhaust purification catalyst 13 are performed. FIG. 22A and FIG. 23A show this first $SO_x$ release control, while FIG. 22B and FIG. 23B show this second $SO_x$ release control.

First, referring to FIG. 22A and FIG. 22B, the first $SO_x$ release control will be explained. As explained above, this first $SO_x$ release control is performed when the $SO_x$ storage amount of the upstream-side end 13*a* of the exhaust purification catalyst 13 for example exceeds a predetermined amount. That is, if it is judged at $t_1$ of FIG. 23A that $SO_x$ should be released from the upstream-side end 13*a*, during the time tx of FIG. 23A, the amount of feed of hydrocarbons from the hydrocarbon feed valve 15 per unit time is increased while performing the $NO_x$ purification action by the first $NO_x$ purification method, and thereby the temperature elevation control of the exhaust purification catalyst 13 is performed.

Next, if the temperature of the exhaust purification catalyst 13 reaches the $SO_x$ release temperature, the air-fuel ratio (A/F)in of the exhaust gas flowing into the exhaust purification catalyst 13, as shown by RA, is made rich for a certain time, for example, 5 seconds, until the targeted rich air-fuel ratio. Note that, in the example shown in FIG. 23A, the air-fuel ratio (A/F)in of the exhaust gas is made rich for a certain time two times at a certain interval. In this case, the air-fuel ratio (A/F)in of the exhaust gas is made rich by injecting additional fuel into the combustion chamber 2 as shown by WR in FIG. 19 or by increasing the amount of feed of hydrocarbons from the hydrocarbon feed valve 15.

If the air-fuel ratio of the exhaust gas is made rich, the reducing intermediate which has built up at the upstream-side end 13*a* is made to be desorbed in the form of ammonia. This desorbed ammonia is used to make the stored $SO_x$ be released from the upstream-side end 13*a* in the form of $SO_2$. This released $SO_2$, as shown in FIG. 22A, moves to the downstream side and is again stored inside the downstream-side catalyst part 13*b* at the downstream side from the upstream-side end 13*a*.

In this case, to prevent the $SO_x$ which was released from the upstream-side end 13*a* from being stored at the downstream-side catalyst part 13*b*, it is necessary to make the atmosphere in the downstream-side catalyst part 13*b* as a whole rich over a long period of time. For that, it is necessary to make the air-fuel ratio (A/F)in of the exhaust gas flowing into the exhaust purification catalyst 13 considerably rich over a long period of time. However, if just making the $SO_x$ be released from the upstream-side end 13*a*, that is, if it is all right that the released $SO_2$ be stored in the downstream-side catalyst part 13*b*, the air-fuel ratio (A/F)in of the exhaust gas does not have to be made that rich. Further, it is enough that the air-fuel ratio (A/F)in of the exhaust gas be made rich for a short time. Therefore, at the time of the first $SO_x$ release control, as shown in FIG. 23A by RA, the targeted air-fuel ratio (A/F)in is not made that rich.

Note that, while saying in this way that the targeted air-fuel ratio (A/F)in is not made that rich, when the air-fuel ratio (A/F)in is made rich, the air-fuel ratio (A/F)in is lowered compared with before it was made rich. Therefore, in the present invention, when $SO_x$ which is stored in the exhaust purification catalyst 13 is to be released, the air-fuel ratio (A/F)in of the exhaust gas which flows into the exhaust purification catalyst 13 is lowered to the targeted rich air-fuel ratio. The amount of additional fuel or the amount of hydrocarbons required for making the air-fuel ratio (A/F)in this targeted rich air-fuel ratio is stored in advance.

Note that, in FIG. 23A, during the rich time period shown by RA, it appears that the air-fuel ratio (A/F)in is continuously made rich in the drawing, but in actuality the air-fuel ratio (A/F)in vibrates by intervals far shorter than at the time of temperature elevation control tx.

Figure 22C:
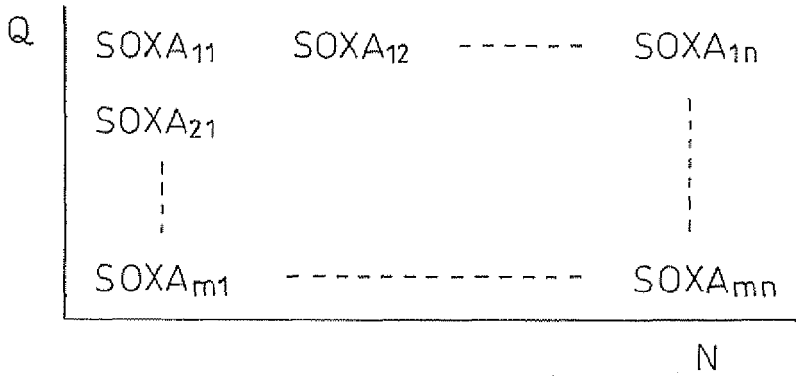

On the other hand, the second $SO_x$ release control is performed when the $SO_x$ and ΣSOX which is stored in the entirety of the exhaust purification catalyst 13 exceeds the allowable value SX. Note that, in the embodiment according to the present invention, the exhausted $SO_x$ amount SOXA of the $SO_x$ which is exhausted per unit time from an engine is stored as a function of the injection amount Q and the engine speed N in the form of a map such as in FIG. 22C in advance in the ROM 32. The exhausted $SO_x$ amount SOXA is cumulatively added to calculate the stored $SO_x$ amount ΣSOX.

That is, in FIG. 23B, if assuming that, at $t_1$, the $SO_x$ amount ΣSOX exceeds the allowable value SX, during the time TX of FIG. 23B, the amount of feed of hydrocarbons from the hydrocarbon feed valve 15 per unit time is increased while performing the $NO_x$ purification action by the first $NO_x$ purification method, and thereby the temperature elevation control of the exhaust purification catalyst 13 is performed.

Next, if the temperature of the exhaust purification catalyst 13 reaches the $SO_x$ release temperature, the air-fuel ratio (A/F)in of the exhaust gas flowing into the exhaust purification catalyst 13, as shown by RA, is made rich for a certain time, for example, 5 seconds, until the targeted rich air-fuel ratio. Note that, in the case shown in FIG. 23B, the air-fuel ratio (A/F)in of the exhaust gas is repeatedly made rich for a certain time. In this case as well, the air-fuel ratio (A/F)in of the exhaust gas is made rich by injecting additional fuel into the combustion chamber 2 as shown by WR in FIG. 19 or by increasing the feed amount of hydrocarbons from the hydrocarbon feed valve 15.

If the air-fuel ratio of the exhaust gas is made rich, the reducing intermediate which builds up on the exhaust purification catalyst 13 is made to desorb in the form of ammonia. This desorbed ammonia enables the stored $SO_x$ to be released from the entirety of the exhaust purification catalyst 13 in the form of $SO_2$. This released $SO_2$, as shown in FIG. 22B, is exhausted from the exhaust purification catalyst 13. At the time of the second $SO_x$ release control, to make the $SO_x$ which is released be exhausted from the exhaust purification catalyst 13 in this way, the air-fuel ratio (A/F)in of the exhaust gas is made considerably rich. Further, the air-fuel ratio (A/F)in of the exhaust gas is repeatedly made rich over a long period of time.

As will be understood if comparing FIG. 23A and FIG. 23B, in an embodiment of the present invention, the time during which the second $SO_x$ release control is performed is made longer than the time during which the first $SO_x$ release control is performed. Further, the targeted rich air-fuel ratio is made lower at the time of the second $SO_x$ release control compared with at the time of the first $SO_x$ release control.

Note that, in the internal combustion engine shown in FIG. 1, at the time of deceleration operation, the throttle valve 10 is made to close. If the throttle valve 10 is made to close, the flow rate of the exhaust gas becomes slower. Therefore, at this time, if feeding hydrocarbons into the combustion chamber 2 or the exhaust passage to perform the temperature elevation action, heat will be applied concentratedly at the upstream-side end 13*a* of the exhaust purification catalyst 13, so the temperature of the upstream-side end 13*a* can be efficiently raised. Therefore, in another embodiment of the present invention, when the exhaust purification catalyst 13 should be raised in temperature for performing the first $SO_x$ release control, at the time of a deceleration operation where the throttle valve 10 is made to close, hydrocarbons are fed into the combustion chamber 2 or upstream of the exhaust purification catalyst 13 in the engine exhaust passage.

Further, at the time of engine high load, high speed operation, the temperature of the exhaust purification catalyst 13 becomes the $SO_x$ release temperature. Therefore, at this time, if performing the first $SO_x$ release control, temperature elevation control of the exhaust purification catalyst 13 no longer is necessary. Therefore, in still another embodiment of the present invention, at the time of engine high load, high speed operation, the first $SO_x$ release control is performed.

Figure 24:
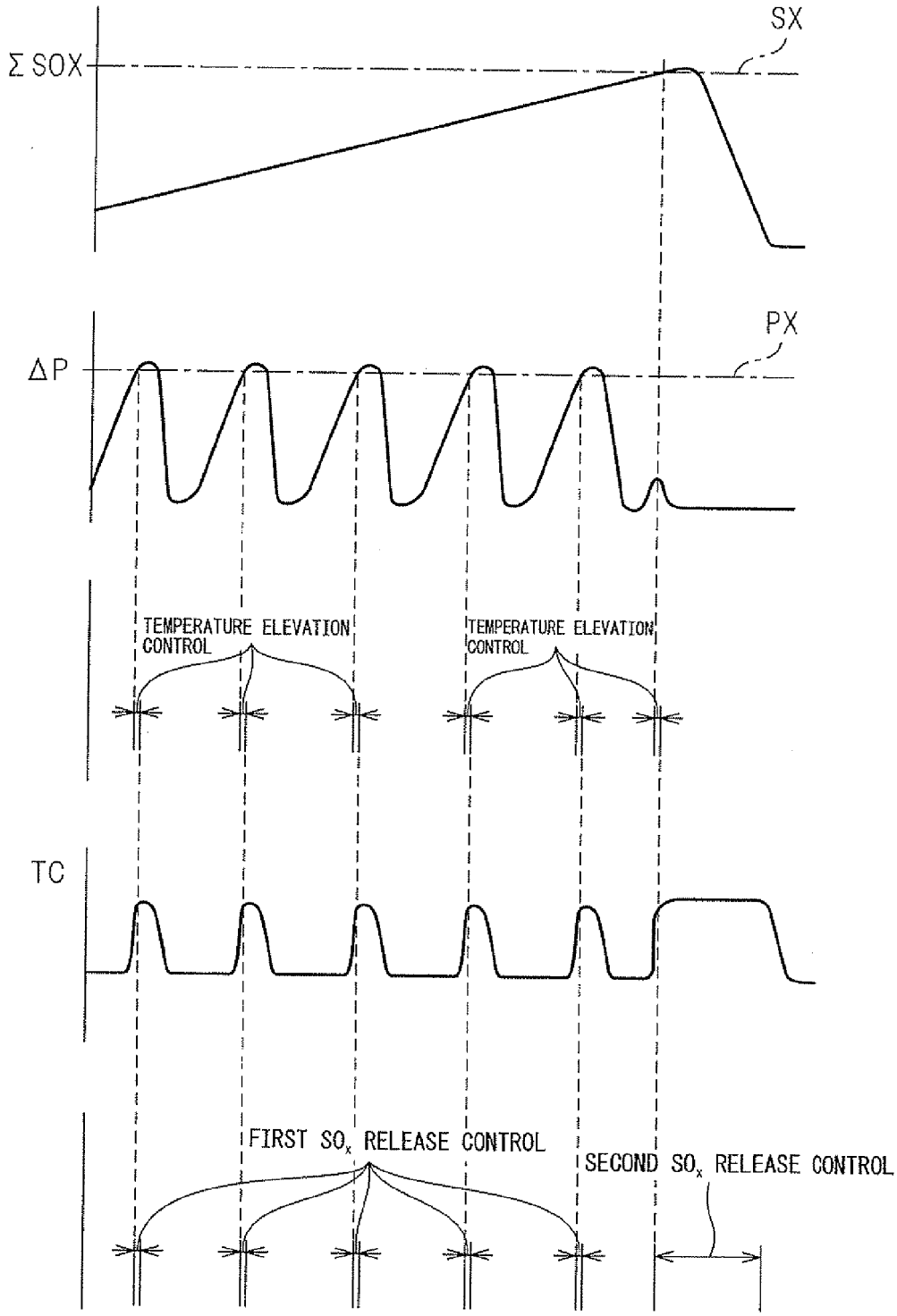
FIG. 24 is a time chart showing $SO_x$ release control.
Figure 25:
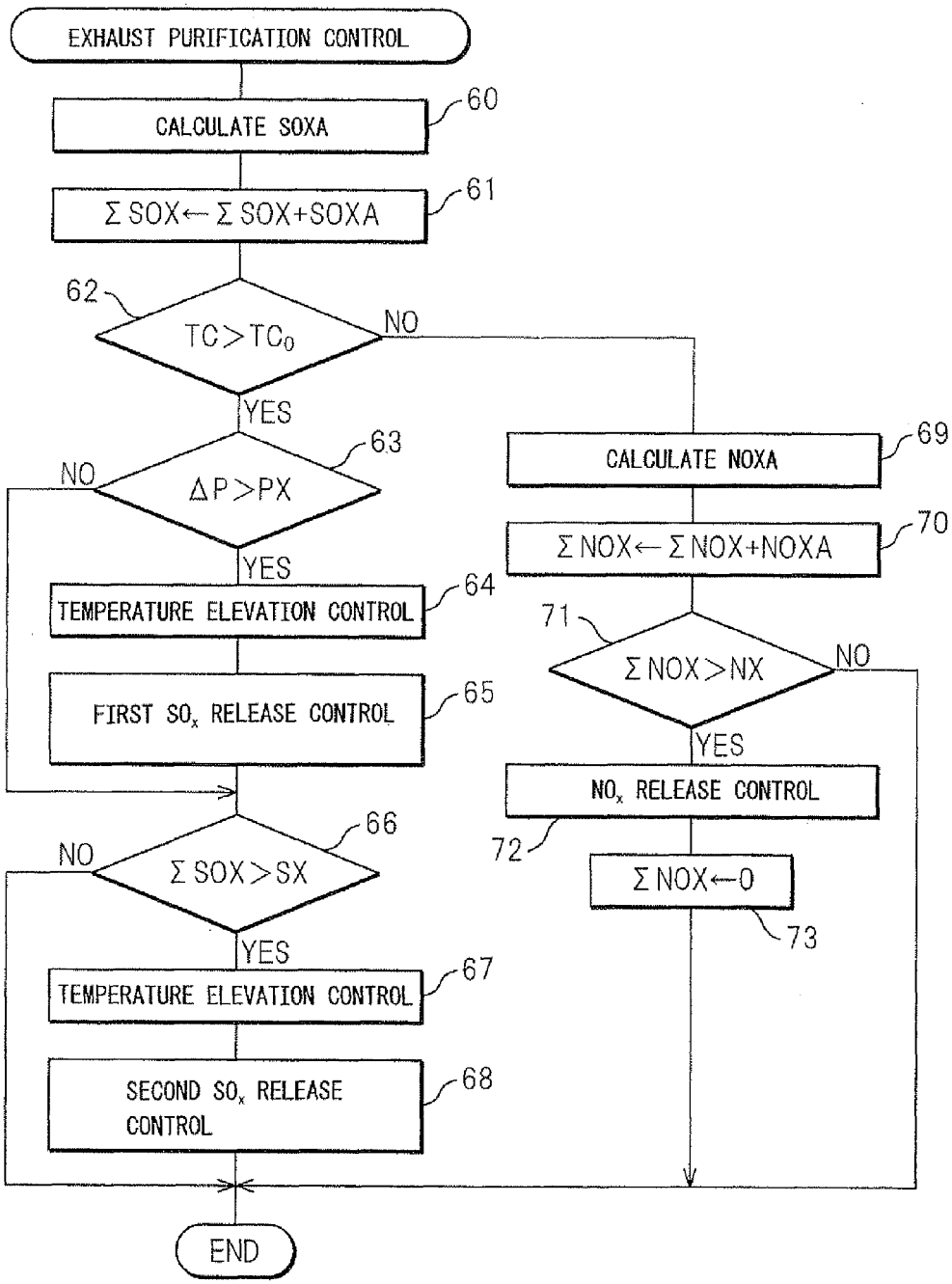
FIG. 25 is a flow chart for exhaust purification control.

Further, in still another embodiment of the present invention, at the time of regeneration of the particulate filter 14, when the exhaust purification catalyst 13 is made to rise in temperature to raise the temperature of the particulate filter 14, the first $SO_x$ release control is performed. If doing this, it is no longer necessary to perform temperature elevation control in the exhaust purification system 13 just for $SO_x$ release control. FIG. 24 shows a time chart in the case of performing the first $SO_x$ release control at the time of regeneration of the particulate filter 14 in this way, and FIG. 25 shows a exhaust purification control in this case.

In FIG. 24, ΔP indicates the differential pressure before and after the particulate filter 14 which is detected by the differential pressure sensor 24. As shown in FIG. 24, if the differential pressure ΔP before and after the particulate filter 14 exceeds the allowable value PX, for example, hydrocarbons are fed from the hydrocarbon feed valve 15 and temperature elevation control of the particulate filter 14 is performed. This temperature elevation control uses the heat of oxidation reaction of the fed hydrocarbons on the exhaust purification catalyst 13 so as to make the temperature of the exhaust gas rise and thereby make the temperature of the particulate filter 14 rise. If the temperature of the particulate filter 14 is made to rise, the particulate which is trapped on the particulate filter 14 will burn and therefore the front-back differential pressure ΔP will gradually fall.

On the other hand, at the time of temperature elevation control of the particulate filter 14, as shown in FIG. 24, the temperature TC of the exhaust purification catalyst 13 also rises. Therefore, at this time, the first $SO_x$ release control is performed. On the other hand, if the stored $SO_x$ amount ΣSOX exceeds the allowable value SX, as shown in FIG. 23B, temperature elevation control is performed, then the second $SO_x$ release control is performed. As shown in FIG. 23B, in this second $SO_x$ release control, a rich air-fuel ratio and a lean air-fuel ratio are repeated, whereby the exhaust purification catalyst 13 is maintained at the $SO_x$ release temperature.

The processing for regeneration of the particulate filter 14 is performed every time the vehicle driving distance reaches 100 km to 500 km. Therefore, the first $SO_x$ release control is performed every time the vehicle driving distance reaches 100 km to 500 km. The total time during which the air-fuel ratio is made rich in this first $SO_x$ release control is a maximum of 30 seconds. As opposed to this, the second $SO_x$ release control is performed every time the vehicle driving distance reaches 1000 km to 5000 km. In this second $SO_x$ release control, the total time during which the air-fuel ratio is made rich is 5 minutes to 10 minutes. In this way, the period by which the second $NO_x$ release control is performed is made longer than the period by which the first $NO_x$ release control is performed.

Next, the exhaust purification control routine shown in FIG. 25 will be explained. This routine is executed by interruption every constant time.

Referring to FIG. 25, first, at step 60, the exhausted $SO_x$ amount SOXA is calculated from the map shown in FIG. 220. Next, at step 61, ΣSOX is increased by the exhausted $SO_x$ amount SOXA to calculate the stored $SO_x$ amount ΣSOX. Next, at step 62, it is judged from the output signal of the temperature sensor 23 if the temperature TC of the exhaust purification catalyst 13 exceeds the activation temperature TX. When TC≥TX, that is, when the exhaust purification catalyst 13 is activated, the routine proceeds to step 63 where it is judged from the output signal of the differential pressure sensor 24 whether the differential pressure ΔP before and after the particulate filter 14 exceeds the allowable value PX.

When ΔP≤PX, the routine jumps to step 66. As opposed to this, when ΔP>PX, the routine proceeds to step 64 where temperature elevation control of the particulate filter 14 is performed, then, at step 65, the first $SO_x$ release control is performed. Next, the routine proceeds to step 66. At step 66, it is judged if the stored $SO_x$ amount ΣSOX exceeds the allowable value SX. When ΣSOX>SX, the routine proceeds to step 67 where temperature elevation control of the exhaust purification catalyst 13 is performed. Next, step 68, the second $SO_x$ release control is performed and ΣSOX is cleared.

On the other hand, when it is judged at step 62 that $TC \leq TC_0$, it is judged that the second $NO_x$ purification method should be used, then the routine proceeds to step 69. At step 69, the $NO_x$ amount NOXA of $NO_x$ exhausted per unit time is calculated from the map shown in FIG. 18. Next, step 70, ΣNOX is increased by the exhausted $NO_x$ amount NOXA to calculate the stored $NO_x$ amount ΣNOX. Next, at step 71, it is judged if the stored $NO_x$ amount ΣNOX exceeds the allowable value NX. When ΣNOX>NX, the routine proceeds to step 72 where the additional fuel amount WR is calculated from the map shown in FIG. 20 and an injection action of additional fuel is performed. Next, at step 73, ΣNOX is cleared.

Note that, as another embodiment, in the engine exhaust passage upstream of the exhaust purification catalyst 13, an oxidation catalyst for reforming the hydrocarbons can be arranged.

REFERENCE SIGNS LIST

4 . . . intake manifold
5 . . . exhaust manifold
7 . . . exhaust turbocharger
12 . . . exhaust pipe
13 . . . exhaust purification catalyst
14 . . . particulate filter
15 . . . hydrocarbon feed valve

The invention claimed is:

1. An exhaust purification system of an internal combustion engine wherein an exhaust purification catalyst for reacting $NO_x$ contained in exhaust gas and reformed hydrocarbons to produce a reducing intermediate containing nitrogen and hydrocarbons is arranged in an engine exhaust passage, a precious metal catalyst is carried on an exhaust gas flow surface of the exhaust purification catalyst and a basic exhaust gas flow surface part is formed around the precious metal catalysts, the exhaust purification catalyst has a property of producing the reducing intermediate and reducing $NO_x$ contained in exhaust gas by a reducing action of the produced reducing intermediate if a concentration of hydrocarbons flowing into the exhaust purification catalyst is made to vibrate within a predetermined range of amplitude and within a predetermined range of period and has a property of being increased in storage amount of $NO_x$ which is contained in exhaust gas if a vibration period of the hydrocarbon concentration is made longer than said predetermined range, at the time of engine operation, to reduce $NO_x$ contained in the exhaust gas in the exhaust purification catalyst, the concentration of hydrocarbons flowing into the exhaust purification catalyst is made to vibrate within said predetermined range of amplitude and within said predetermined range of period, and, when a stored $SO_x$ should be released from the exhaust purification catalyst, an air-fuel ratio of the exhaust gas which flows into the exhaust purification catalyst is lowered to a targeted rich air-fuel ratio to make the reducing intermediate built up on the exhaust purification catalyst desorb in the form of ammonia and the desorbed ammonia is used to make the exhaust purification catalyst release the stored $SO_x$.

2. An exhaust purification system of an internal combustion engine as claimed in claim 1, wherein a first $SO_x$ release control which uses the desorbed ammonia to release the stored $SO_x$ from an upstream-side end of the exhaust purification catalyst and a second $SO_x$ release control which release the stored $SO_x$ from an entirety of the exhaust purification catalyst are performed and wherein a time during which the second $SO_x$ release control is performed is made longer than a time during which the first $SO_x$ release control is performed.

3. An exhaust purification system of an internal combustion engine as claimed in claim 2, wherein a period in which the second $NO_x$ release control is performed is longer than a period in which the first $NO_x$ release control is performed.

4. An exhaust purification system of an internal combustion engine as claimed in claim 2, wherein the targeted rich air-fuel ratio is made lower at the time of the second $SO_x$ release control compared with the time of the first $SO_x$ release control.

5. An exhaust purification system of an internal combustion engine as claimed in claim 2, wherein a particulate filter is arranged inside the engine exhaust passage downstream of the exhaust purification catalyst and wherein the first $SO_x$ release control is performed at the time when the exhaust purification catalyst is made to rise in temperature to raise a temperature of the particulate filter at the time of regeneration of the particulate filter.

6. An exhaust purification system of an internal combustion engine as claimed in claim 2, wherein the first $SO_x$ release control is performed at the time of engine high load, high speed operation.

7. An exhaust purification system of an internal combustion engine as claimed in claim 2, wherein a throttle valve is provided for control of an intake air amount and wherein when the exhaust purification catalyst should rise in temperature for the first $SO_x$ release control, hydrocarbons are fed into a combustion chamber or into the engine exhaust passage upstream of the exhaust purification catalyst at the time of a deceleration operation where the throttle valve is made to close.

8. An exhaust purification system of an internal combustion engine as claimed in claim 1, wherein said vibration period of the hydrocarbon concentration is between 0.3 second to 5 seconds.

9. An exhaust purification system of an internal combustion engine as claimed in claim 1, wherein said precious metal catalyst is comprised of platinum Pt and at least one of rhodium Rh and palladium Pd.

10. An exhaust purification system of an internal combustion engine as claimed in claim 1, wherein a basic layer containing an alkali metal, an alkali earth metal, a rare earth, or a metal which can donate electrons to $NO_x$ is formed on the exhaust gas flow surface of the exhaust purification catalyst and wherein a surface of said basic layer forms said basic exhaust gas flow surface part.

* * * * *